US010494856B2

(12) United States Patent
Bernkrant et al.

(10) Patent No.: US 10,494,856 B2
(45) Date of Patent: Dec. 3, 2019

(54) PORTABLE SAFE

(71) Applicants: Keith Bernkrant, Cape Canaveral, FL (US); Paul Richter, Titusville, FL (US)

(72) Inventors: Keith Bernkrant, Cape Canaveral, FL (US); Paul Richter, Titusville, FL (US)

( * ) Notice: Subject to any disclaimer, the term of this patent is extended or adjusted under 35 U.S.C. 154(b) by 2 days.

(21) Appl. No.: 15/544,738

(22) PCT Filed: Sep. 21, 2015

(86) PCT No.: PCT/US2015/051285
§ 371 (c)(1),
(2) Date: Jul. 19, 2017

(87) PCT Pub. No.: WO2016/118195
PCT Pub. Date: Jul. 28, 2016

(65) Prior Publication Data

US 2018/0274281 A1 Sep. 27, 2018

Related U.S. Application Data

(60) Provisional application No. 62/119,099, filed on Feb. 20, 2015, provisional application No. 62/105,201, filed on Jan. 19, 2015.

(51) Int. Cl.
*F41C 33/02* (2006.01)
*E05G 1/10* (2006.01)
(Continued)

(52) U.S. Cl.
CPC ..... *E05G 1/10* (2013.01); *E05B 39/005* (2013.01); *E05B 47/0001* (2013.01);
(Continued)

(58) Field of Classification Search
CPC .. F41C 33/02; F41C 33/0209; F41C 33/0263; F41C 33/029; F41C 33/048; F41C 33/06
(Continued)

(56) References Cited

U.S. PATENT DOCUMENTS 3,669,325 A 6/1972 Furman
3,688,953 A 9/1972 Bianchi
(Continued)

OTHER PUBLICATIONS

PCT International Search Report, dated Jan. 28, 2016.
(Continued)

*Primary Examiner* — Corey N Skurdal
(74) *Attorney, Agent, or Firm* — Stephen C. Thomas

(57) ABSTRACT

A portable safe for a firearm or other valuable, which may be worn on a belt, comprising a first plate and second cover hingedly connected along a bottom edge, and comprising a latch along a top edge. The latch may be manually operated and may be remotely lockable to prevent unauthorized opening. A firearm may be stored in the invention by placing the barrel of the gun onto a barrel pin in a sliding engagement. The barrel pin may be long enough to protrude into the chamber of the invention to prevent storage of a firearm that has a round in the chamber. The portable safe may be configured for left or right hand draw. The invention may comprise a GPS receiver such that its location may be easily ascertained. The safe comprises safety features preventing unauthorized use while allowing an authorized user quick access to its contents.

75 Claims, 23 Drawing Sheets

(51) Int. Cl.

| | |
|---|---|
| ***F41C 33/06*** | (2006.01) |
| ***E05B 39/00*** | (2006.01) |
| ***E05B 47/00*** | (2006.01) |
| ***E05B 49/00*** | (2006.01) |
| ***E05B 65/00*** | (2006.01) |
| ***E05G 1/00*** | (2006.01) |
| ***E05G 1/04*** | (2006.01) |
| *A45F 5/02* | (2006.01) |
| *E05C 1/04* | (2006.01) |

(52) U.S. Cl.
CPC ..... *E05B 49/00* (2013.01); *E05B 65/0075* (2013.01); *E05G 1/005* (2013.01); *E05G 1/04* (2013.01); *F41C 33/029* (2013.01); *F41C 33/0218* (2013.01); *F41C 33/0263* (2013.01); *F41C 33/06* (2013.01); *A45F 5/021* (2013.01); *A45F 2200/0591* (2013.01); *E05C 1/04* (2013.01); *E05Y 2201/434* (2013.01); *E05Y 2400/32* (2013.01); *E05Y 2400/612* (2013.01); *E05Y 2400/664* (2013.01); *E05Y 2900/60* (2013.01)

(58) Field of Classification Search
USPC ..... 224/676
See application file for complete search history.

(56) References Cited

U.S. PATENT DOCUMENTS

| | | | | |
|---|---|---|---|---|
| 3,707,250 | A | 12/1972 | Esposito | |
| 3,731,858 | A | 5/1973 | Baker | |
| 4,273,276 | A | 6/1981 | Perkins | |
| 4,277,007 | A | 7/1981 | Bianchi et al. | |
| 4,298,150 | A | 11/1981 | Seldeen | |
| 4,312,466 | A | 1/1982 | Clark | |
| 4,318,503 | A | 3/1982 | Capano | |
| 4,325,505 | A | 4/1982 | Hillman | |
| 4,325,506 | A | 4/1982 | Lindell et al. | |
| 4,378,082 | A | 3/1983 | Chica | |
| 4,410,118 | A | 10/1983 | Taurisano | |
| 4,463,884 | A | 8/1984 | Parlante | |
| 4,471,894 | A | 9/1984 | Neely | |
| 4,480,776 | A | 11/1984 | Atkins, Sr. | |
| 4,485,947 | A | 12/1984 | Cook | |
| 4,485,948 | A | 12/1984 | Cook | |
| 4,542,841 | A | 9/1985 | Bianchi et al. | |
| 4,591,081 | A | 5/1986 | Bianchi et al. | |
| 4,620,654 | A | 11/1986 | Cook | |
| 5,048,682 | A * | 9/1991 | Taylor | F41C 33/06 206/317 |
| 5,671,830 | A * | 9/1997 | Wood | A45C 13/02 150/101 |
| 5,828,301 | A | 10/1998 | Sanchez | |
| 6,588,635 | B2 | 7/2003 | Vor Keller et al. | |
| 6,918,519 | B2 | 7/2005 | Vor Keller et al. | |
| 7,200,965 | B2 | 4/2007 | Vor Keller et al. | |
| 8,727,294 | B1 * | 5/2014 | Harms | F41A 23/18 206/317 |
| 9,500,441 | B2 * | 11/2016 | Kirby, Jr. | F41C 33/06 |
| 10,180,303 | B2 * | 1/2019 | Gilbert | F41C 33/041 |
| 2001/0033228 | A1 | 10/2001 | Kisreman et al. | |
| 2003/0057122 | A1 * | 3/2003 | Bushnell | E05B 47/0002 206/317 |
| 2004/0066275 | A1 | 4/2004 | Mickler | |
| 2008/0061991 | A1 | 3/2008 | Urban et al. | |
| 2014/0215881 | A1 | 8/2014 | Milde, Jr. et al. | |
| 2014/0366419 | A1 | 12/2014 | Allan | |
| 2016/0054080 | A1 | 2/2016 | Haimi | |
| 2016/0116253 | A1 | 4/2016 | Moon | |

OTHER PUBLICATIONS

PCT Written Opinion of the International Searching Authority, dated Jan. 28, 2016.
PCT Search Strategy, dated Dec. 29, 2015.
PCT/US15/51285 PCT International Search Report, dated Jan. 28, 2016.
PCT/US15/51285 PCT Written Opinion of the International Searching Authority, dated Jan. 28, 2016.
PCT/US15/51285 PCT Search Strategy, dated Dec. 29, 2015.

* cited by examiner

UNLOCKED/UNLATCHED

UNLOCKED/LATCHED

LOCKED/LATCHED

PORTABLE SAFE

CROSS REFERENCE TO RELATED APPLICATIONS

This international patent application, filed with the United States Receiving Office under the Patent Cooperation Treaty (PCT), claims the benefit of U.S. provisional patent application Ser. No. 62/105,201 titled CONCEALED CARRY CONTAINER, filed in the United States Patent and Trademark Office (USPTO) on 19 Jan. 2015, which is hereby incorporated in its entirety by reference; and this PCT patent application also claims the benefit of U.S. provisional patent application Ser. No. 62/119,099 titled PORTABLE SAFE, filed in the United States Patent and Trademark Office (USPTO) on 20 Feb. 2015, which is also hereby incorporated in its entirety by reference.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not applicable.

BACKGROUND OF THE INVENTION

1. Field of the Invention

The field of the invention relates generally to portable safes, sometimes called diversion containers, in which valuables may be stored and hidden from view in a container that has the appearance of an everyday item of limited value, or at least an item that is commonly used in public and therefore unremarkable by its presence. More specifically, a preferred embodiment and best mode of the invention is directed to a concealment container for valuables, which may be jewelry, money, personal identification information; or, in an embodiment, may be a firearm such as a firearm. In an embodiment the invention conceals a firearm in a securable portable safe, or container, where it may be safely carried but which in which the firearm is readily accessible to aid in personal defense. The portable safe of the invention may be used to carry any object desired by the user. The field of the invention also includes portable safes or containers that may be remotely accessible for the purpose of remotely locking and securing the safe and the contents therein, reporting condition of the portable safe, and reporting geolocation information.

2. Background Art

It is often desirable that valuable items such as, for example, jewelry, money, credit cards, personal identification information, prescription medications, and other valuable items be carried on or with a person without revealing that the user is carrying such items. Some valuable items, such as firearms, must be concealed from view in certain situations such as in public, in certain jurisdictions, due to laws or ordinances that require concealment.

It is well known that various wallets, purses, and other containers have been used to carry valuable items; likewise holsters have been developed that may hold a firearm in various locations on a person's body, for example inside the waistband of the wearer's pants or on or near the wearer's chest, such as a shoulder harness worn under the user's clothing. These apparatuses and methods for concealed carry of valuables or weapons are generally subject to certain drawbacks. For instance, the inside-the-waistband holsters may be uncomfortable, may require unfashionable clothing or, if the user's clothing is too tight, may show, or "print", the outline of the firearm and thereby alert others in the vicinity that the user is carrying a concealed weapon. An additional drawback of inside-the-waistband holsters is that they may impede the drawing the firearm in an emergency if they shift during wearing or if the user's pants are too tight. Alternatively, shoulder harnesses may be worn for concealed carry of a firearm, but these must generally be worn under the user's shirt or outer garment. If worn under the outer garment, which may be for example a coat, the user is prevented from removing the outer garment because the firearm may be revealed. If worn under an inner garment such as a shirt, the drawing the firearm may be impeded due to the fact that the firearm is beneath the wearer's shirt. Another drawback of the concealed carry holsters of the prior art is that they may not be lockable so as to prevent unauthorized access to a firearm or valuable object(s) stored in them. And, in any event, the purses, wallets, and holsters of the prior art are not remotely lockable, nor do they provide status or geolocation information to a remote user.

What is needed in the art, therefore, is an apparatus and/or method such as a portable safe that conceals valuables such as money, important documents, medications or other items, or may conceal a firearm such that it may be carried by a user without displaying the firearm or the firearm's outline, while allowing for quick and easy removal of the items or firearm when desired by a user. It would further be desirable that such a portable safe be lockable by a user, either locally or remotely, and that the portable safe be capable of reporting its geolocation and status to a remote user.

BRIEF SUMMARY OF THE INVENTION

The present invention comprises an apparatus and method that have one or more of the following features and/or steps, which alone or in any combination may comprise patentable subject matter.

The present invention overcomes the shortcomings of the prior art in that it may be used to conceal a firearm or other valuable item within an enclosed interior volume such that it may be carried by a user without displaying the item's outline. The invention also allows quick drawing of a firearm so that the firearm is readily available for use in emergency situations. The invention may also be locally lockable by a user using, for example, a keypad or push-button array to enter authenticating information such as a personal identification number, or may be remotely lockable by a user by means of communication over a wireless or wired communication interface; may comprise an optional geolocation receiver such as a GPS receiver for geolocation of the portable safe and its contents; and may comprise one or more means for communication with a remote user or system, such as a remote user data interface that may include radiofrequency wireless and optical communications transceivers, wired data communications ports and the like, in any combination. In this manner, a user may lock a portable safe of the invention manually, or from a remote location, so that it is not accessible by an unauthorized user. Likewise, a remote user may be able to track the geographic location of a portable safe of the invention and its contents by utilizing received geo-positioning information, such as through a GPS receiver, or cell-based geolocation information, that is reported from a portable safe of the invention to a remote user; or geolocation information regarding the geographic location of the portable safe may be independently reported from cell towers and data network systems to which the portable safe is wirelessly connected through radiofrequency or other wireless communications means such as, for instance and not by way of limitation, cellular communication systems such as Global System for Mobile Communications, or GSM; analog data networks; wireless Local Area Networks (LANs) such as Wi-Fi; point to point communication systems such as Bluetooth®; or any other radiofrequency or optical communication systems known in the art. The portable safe may also report its condition and/or status, such as "open", "closed", "locked" or "unlocked" to a user such as a remote user communicating with the portable safe via a wireless network in communication with the world wide web.

The portable safe of the invention comprises various embodiments. The scope of the invention includes the detailed description of the invention presented herein and all equivalent embodiments thereof. The embodiments of the invention may be generally described as being directed towards either a non-electronic embodiment of the invention, or an electronic embodiment of the invention. In the detailed description provided herein, a non-electronic embodiment of the invention is described as a first embodiment, followed by a description of an electronic embodiment of the invention as a second embodiment. Each embodiment has various optional features and embodiments as described and claimed herein.

In the embodiments, the portable safe of the invention may comprise a first portion and a second portion, each of which may comprise interior and exterior surfaces, that are hingedly attached and rotate together to form an enclosed interior volume. An optional barrel pin may be attached to an interior surface of the enclosed volume for allowing a firearm, which may be a firearm, to be inserted onto the barrel pin by sliding the barrel of the firearm onto the barrel pin, forming a sliding engagement between barrel pin and firearm barrel.

The portable safe of the invention, in any of the embodiments described and claimed, may further provide concealment or diversion by being formed in the appearance of a cell phone case, eyeglasses case, or some similar well known case shape.

In any of the embodiments of the portable safe claimed and described, the barrel pin may be long enough to prevent a full sliding engagement with a firearm that has an ammunition round chambered. In any of the embodiments using this long barrel pin feature, the barrel pin length is defined to be longer that the length of the open space in the firearm when an ammunition round is chambered in the firearm. "Full sliding engagement", as used herein, means that when a firearm is slidingly engaged with the barrel pin of the invention such that the barrel pin is inserted as far as is possible into the firearm barrel, the barrel pin is in physical contact with the chambered ammunition round preventing the firearm from sliding further onto the barrel pin, and the portions of the portable safe are not able to be disposed into a closed position because they cannot be closed around the firearm due to a portion of the firearm, such as, for example, the handle, physically preventing closure of the portable safe portions. This safety feature ensures that only firearms that do not have an ammunition round chambered may be carried in this embodiment of the invention, preventing accidental discharge when placing the firearm onto the barrel pin or removing it from the portable safe. For purpose of this description, "ammunition round" means a cartridge having a bullet as may be inserted into the chamber of a firearm, and fired, projecting the bullet through and out of the firearm barrel.

In accordance with a first embodiment of the invention, the portable safe comprises no electromagnetic lock, and may be latched into a closed position by a latch that, when in a "latched" position, prevents the portions of the portable safe from being disposed in an open position. When the latch is disposed in an "unlatched" position, the portions of the portable safe are able to be disposed in an open position, exposing the interior volume and any items contained therein. Thus, in order to retrieve an item from the first embodiment of the portable safe, a user places the latch into the unlatched state, allowing the portable safe to be rotated into an open position, and, in an embodiment, allowing the user to retrieve an item such as a firearm by grasping a portion of the firearm and sliding the firearm off the barrel pin utilizing the sliding engagement between the barrel pin and the barrel of the firearm. In this embodiment the user is now holding the firearm and is ready for self-defense. When ready to re-insert the firearm in to the portable safe, starting with the safe in the open position, the user slides the barrel of the firearm onto the barrel pin in a sliding engagement and then may close the first and second portions of the safe together by rotating them together on a hinged attachment between them, forming an enclosed interior volume that encloses and conceals the firearm. The mechanical latch may be placed into the latched position, which may occur automatically or by user manipulation of the mechanical latch, preventing the portable safe from falling open unless the latched is placed into the unlatched position. In the first embodiment, the portable safe of the invention further comprises a mechanical lock operated by a key. The mechanical lock has two states: "locked" and "unlocked". In the locked state, the lock prevents the latch from being motivated into an unlatched position. In the unlocked state, the lock allows the latch to be motivated into an unlatched position. Thus in the first embodiment of the invention, the portable safe may be placed into one of at least three states: an "open" state, in which the first and second portions of the portable safe are not rotated into a closed position, and a user may retrieve a firearm or other valuable from the open portable safe; a "closed, latched and unlocked" state, in which the first and second portions of the portable safe are rotated together into a closed position forming an enclosed interior volume, the mechanical latch is in a "latched" position, and the lock is in an "unlocked" state, allowing an item enclosed within the enclosed interior volume formed by the first portion and second portion being disposed in a closed position to be concealed from view but accessible by motivating the latch into an unlatched position, thus allowing the first and second portions to rotate away from each other and placing the portable safe in an open position; and a "closed, latched and locked" state, in which the first and second portions have been rotated together into a closed position forming in interior enclosed volume, the latch is in a latched position, and the lock is disposed in a locked state. In the closed, latched and locked condition the portable safe cannot be opened by motivation of the latch into an unlatched position, as this is prevented by the lock being disposed in a locked state.

In accordance with a second embodiment of the portable safe of the invention, the lock of the invention is further defined as an electromechanical lock in communication with a controller. When the electromechanical lock is in a locked state, the latch cannot be manually motivated to an unlatched position by a user. The electromechanical lock may be commanded by a controller into a "locked" state or an "unlocked" state.

Either the first embodiment or second embodiment of the invention may further comprise geo-positioning electronic components such as a geolocation receiver, which may be a Global Position System (GPS) receiver, capable of receiving geo-locating signals from, for example, remote transmitters such as, but not limited to, GPS or other geo-positioning satellites, processing said geo-locating signals, and transmitting a signal comprising geolocation information through a remote user data interface to a remote user who, for example, may communicate with a portable safe of the invention through a world wide web interface on the internet that is in data communication with the portable safe through the user data interface. The portable safe may further comprise a controller capable of executing computer executable instructions stored in a non transitory computer readable medium that is in communication with the controller; a battery or other power source in electrical communication with the controller and non transitory computer readable medium; and a wired electrical interface, which may be, for example an electrical communications port such as a Universal Serial Bus (USB) port or parallel data port in communication with the non transitory computer readable medium and controller for programming the non transitory computer readable medium by communicating computer executable instructions to the non transitory computer readable medium for storage and later retrieval and execution by the controller. The controller and battery or other power source may be in electrical communication with the GPS receiver. Likewise, in the second embodiment, the controller and battery or other power source may be in electrical communication with the electromechanical latch so that the controller may command the electromechanical latch into any of the states or conditions described herein.

In an alternate embodiment, the geolocation receiver may comprise a wireless transceiver such as an RF transceiver capable of communicating with a remote wireless receiver for the purpose of transmitting a signal comprising geolocation information to a remote receiver without the need to transmit the signal comprising geolocation information through a controller to a remote receiver. In this embodiment, the portable safe of the invention may thus comprise the ability to transmit a signal comprising geolocation information to a remote receiver without the need for a controller or separate wireless transceiver.

The present method and device of the invention overcome the shortcomings of the prior art by allowing a user to carry a concealed firearm or other object while only presenting the appearance of carrying a cell phone, while still allowing for quick, unimpeded access to a firearm or other valuable being carried in the portable safe of the invention.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating the preferred embodiments of the invention and are not to be construed as limiting the invention. In the drawings.

DETAILED DESCRIPTION OF THE INVENTION

The following provides a detailed description of the invention. Although a detailed description as provided herein contains many specifics for the purposes of illustration, anyone of ordinary skill in the art will appreciate that many variations and alterations to the following details are within the scope of the invention. Accordingly, the following preferred embodiments of the invention are set forth without any loss of generality to, and without imposing limitations upon, the claimed invention. Thus the scope of the invention should be determined by the appended claims and their legal equivalents, and not merely by the preferred examples or embodiments given.

As used herein, "memory", "medium", "computer readable memory", "computer readable medium", "storage media", "computer readable storage media" and "computer readable storage medium" shall include within their meanings only physical non-transitory computer readable hardware, and such terms shall specifically exclude signals per se, carrier waves, propagating signals and other transitory signals. Such physical non transitory computer readable media, may comprise hardware memory that comprises a physical structure for storing data which may include computer executable instructions or data.

As used herein, "remote user data interface" means one or any combination of wired or wireless communications interfaces known in the art including wired serial buses such as USB, RS-232 or other serial data interfaces; wired parallel data buses; radiofrequency or other wireless communications means such as, for instance and not by way of limitation, cellular communication systems such as CDMA or Global System for Mobile Communications, or GSM; analog data networks; wireless Local Area Networks (LANs) such as the Institute of electrical and Electronic Engineers (IEEE) 802.11 standard known as Wi-Fi®; point to point communication systems such as Bluetooth®; infrared optical communications systems; or any other radiofrequency or optical communication systems known in the art in which a remote user can communicate with a local device either directly or through data interfaces with the world wide web.

Figure 1:
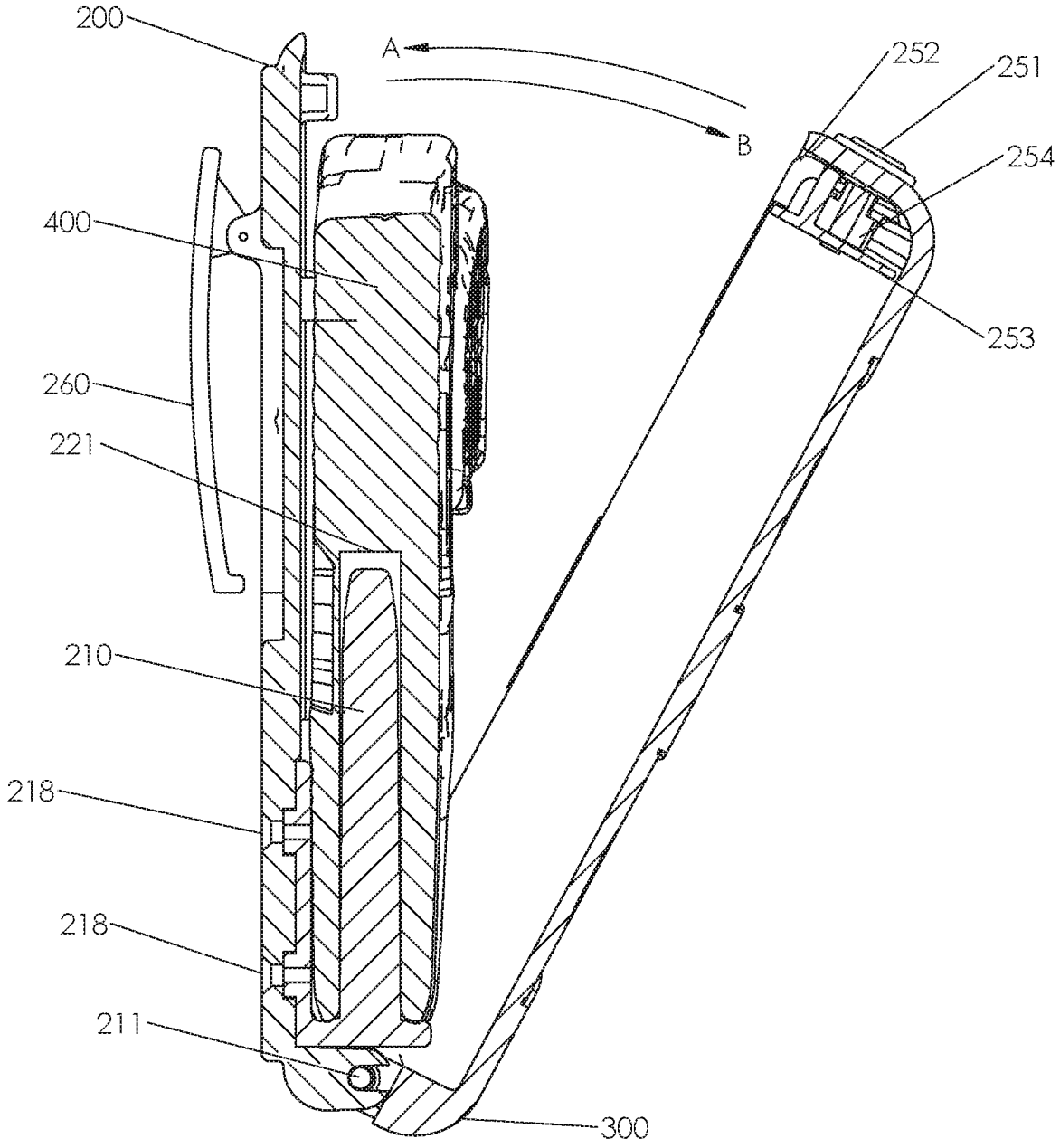
FIG. 1 depicts a cross-sectional view of a non-electronic first embodiment of the invention, a non-electronic embodiment, showing the portable safe of the invention rotating towards an open position, with a firearm placed inside having its barrel slidingly engaged onto a barrel pin.

Referring now to FIG. 1, a cross-sectional view of an embodiment of the invention showing the portable safe of the invention in a partially open position with a firearm 400 placed inside the portable safe is depicted. The portable safe of the invention may comprise a first portion such as back plate 200 hingedly attached to a second portion such as front cover 300 using, for example, a hinge pin 211 which may be an elongated cylindrical pin comprised of metal or any other rigid material suitable for operating as a hinge pin and received in a rotable engagement by receiving cylindrical structures in the bottom edge of front cover 300 and back plate 200. In FIG. 1, the portable safe of the invention is shown with front cover 300 rotating into an open position in the direction of arrow B, allowing quick and easy access to firearm 400. In the open position, a user may access firearm 400 for use in emergency or self-defense situations, or in any other situation in which it is desired to access firearm 400.

Operating slide latch 251 located on a top surface of front cover 300 into an unlatched position disengages front cover 300 from back plate 200 along the top edge of the portable safe, which is a an edge opposing the edge comprising the rotable hinged connection about hinge pin 211, allowing front cover 300 to rotate away from back plate 200 in the direction of arrow B about an axis formed by hinge pin 211. Alternatively, front cover 300 may be rotated on hinge pin 211 from an open position to a closed position along the direction of arrow A. As front cover 300 rotates into a closed position in the direction of arrow A, it may come into contact with back plate 200, whereupon the latch mechanism of the invention engages to securely attach the top edge of front cover 300 the top edge of the back plate 200 in a closed position. The slide mechanism may comprise a first slide plate 252 and a slide cover 253.

Still referring to FIG. 1, a firearm 400, which may be any type of firearm such as a pistol, any kind of handgun or other firearm, may be placed onto barrel pin 210 by means of a sliding engagement between a portion of outer diameter of barrel pin 210 and the inner diameter of the barrel 221 of the firearm. Barrel pin 210 may slide into the barrel 221 of firearm 400 in a fit that may be a loose sliding engagement or any other sliding engagement. Barrel pin 210 may be, but is not necessarily, comprised of plastic material, which may be molded, printed using additive manufacturing technology, machined, cast, or manufactured by any method known in the art for fabricating plastic material. Barrel pin 210 may also be comprised of metal, phenolic or any other material suitable for retaining a firearm by the sliding engagement of barrel pin 210 into barrel 221. A latch comprising latch thumb plate 251, first slide plate 252, and slide cover 253 operate to latch front cover 300 against back plate 200 when the portable safe is in a closed position (the closed position is not depicted in FIG. 1 but is depicted in FIGS. 3, 4, 5 and 9A) as is further described below in relation to FIGS. 2, 9A and 9B.

Still referring to FIG. 1, the portable safe of the invention may comprise a clip 260 that may be spring-loaded and, in an embodiment, may also be rotatably attached to a back surface of the back plate 200 of the invention by means of a button or other similar structure as is known in the art. Clip 260 may be rotatably engaged with a back surface of back plate 200, allowing the portable safe of the invention to be oriented at any angle relative to the mounting structure to which it may be removably attached. Clip 260 may be spring-loaded such that it is releasably attachable to a mounting structure such as, for example, a belt of a user, a pocket of a user, the waistband of a user's pants, or any other structure able to accept clip 260. Clip 260 may take any shape suitable for removably attaching to an article of clothing such as a pants belt. Thus the portable safe of the invention may be worn and carried on the belt of a user as is further depicted in FIGS. 7A and 7B. In an embodiment, threaded fasteners such as those shown as items 218 may attach barrel pin 210 to an interior surface of back plate 200.

Figure 2:
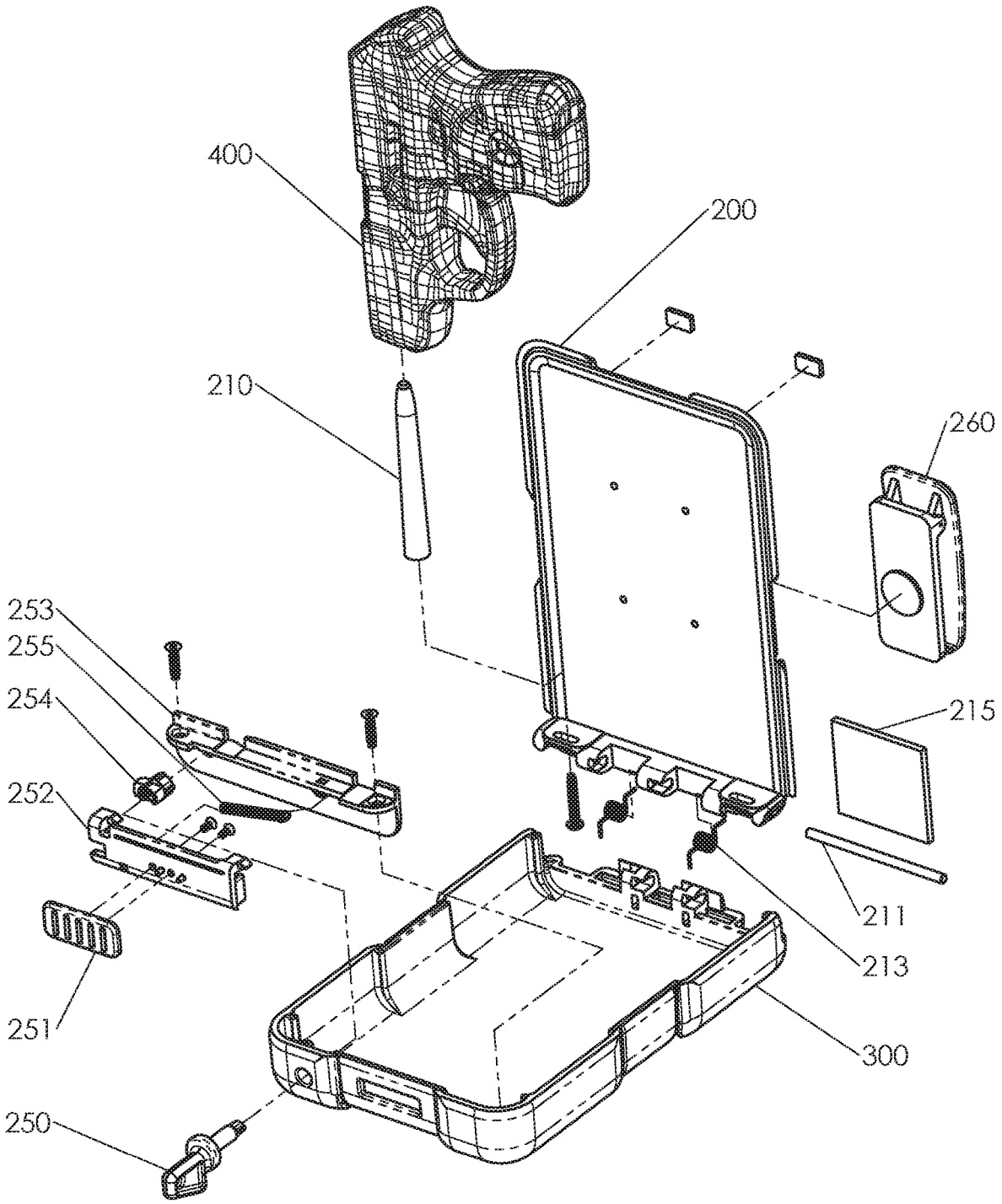
FIG. 2 depicts an exploded view of a non-electronic first embodiment of the portable safe of the invention in an open position, indicating the manner in which the various components of the invention are assembled together and showing the placement of a firearm onto the barrel pin of the invention.
Figure 6:
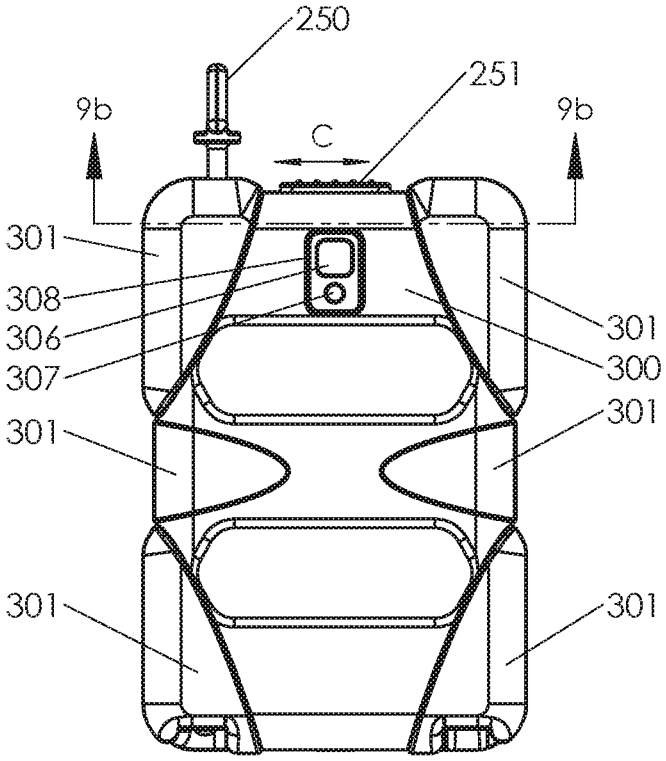
FIG. 6 depicts a front view of an embodiment of the portable safe of the invention in a closed position, in which the first portion and second portions of the safe have been rotated together, forming an enclosed volume, and further showing the movement of the slide latch mechanism, and showing a key inserted into the lock of the invention.

Referring now to FIG. 2, an exploded view of an embodiment of the portable safe of the invention in an open position is depicted, indicating the manner in which the various components of this embodiment of the invention may be assembled together, and showing the placement of a firearm 400 onto the barrel pin 210. Front cover 300 is hingedly engaged with back plate 200 along a bottom edge of both front cover 300 and back plate 200. The rotable hinged engagement between back plate 200 and front cover 300 is established by hinge pin 211 which is received by alternating receiving cylindrical structures disposed along the bottom edge of each of front cover 300 and back plate 200. At least one torsion spring 213 comprising tangs may surround portions of the cylindrical outer diameter of hinge pin 211, with the tangs placed against a surface of each of front cover 300 and back plate 200 so as to provide an opening force tending to cause front cover 300 to rotate away from back plate 200 on hinge pin 211 when front cover 300 is not latched into place against back plate 200 by, for example, a latch comprising latch thumb plate 251, first slide plate 252, slide cover 253, and latch spring 255. Slide cover 253 is attached to an interior surface of front cover 300 and is slidingly engaged with first slide plate 252 such that they may slide relative to one another in the direction of arrow C as depicted in FIG. 6. Latch thumb plate is attached to first slide plate 252.

In the embodiment depicted in FIG. 2, at least one torsion spring 213 causes a force on front cover 300 tending to motivate it to rotate into the open position, such that the portable safe tends to remain in an open position as long as it is not rotated by an external force, such as the hand of a user, against, and latched to, back plate 200. Key 250 may be inserted thru an opening in the top surface of front cover 300 and may extend into and engage lock 254. When lock key 200 is rotated, lock 254 is also caused to rotate into either a locked position or an unlocked position. In the locked position, lock 254 prevents latch thumb plate 251 from being motivated so as to place the latch in an unlatched state. In the unlocked position, lock 254 allows latch thumb plate 251, which is attached to first slide plate 252, to be motivated so as to place the latch in an unlatched state. Latch spring 255 has a first end and a second end; the first end being attached to a non-moving interior structure such as slide cover 253, and the second end being attached to a surface of first slide plate 252, thus tending to cause first slide plate 252 to experience a force tending to motivate first slide plate 252 to slide into the latched position on slide cover 253. Key 250 and lock 254 therefore provide a safety feature that prevents unauthorized opening of the portable safe of the invention. First slide plate 252 may comprise pawls that are received by matching openings in structure attached to, or part of, slide cover 253 when the latch is in a latched position, thus preventing front cover 300 from rotating away from back plate 200 on the hinged connection formed by hinge pin 211 and the receiving cylindrical structures disposed along the bottom edge of each of front cover 300 and back plate 200. When the latch is disposed in an unlatched position, the pawls of first slide plate 252 are retracted from and therefore not receive by the matching openings in structure attached to, or part of, slide cover 253, allowing front cover 300 to rotate away from back plate 200 and into an open position on the hinged connection formed between front cover 300 and back plate 200 by hinge pin 211. Barrel pin threaded fastener 617 may attach barrel pin 210 to a surface of front cover 300, or to a structure attached to a surface of front cover 300.

Still referring to FIG. 2, optional barrel pin 210 may be attached to an interior surface and may be disposed in such a position as to allow a sliding engagement with the barrel of a firearm 400, so that front cover 300 may be rotated into a closed position against back plate 200 and latched there by operation of the latch, forming an interior enclosed volume that is able to accept firearm 400 while in the closed position and thereby concealing firearm 400 from view. Fastening hardware such as, for example, a male threaded fastener may be utilized to secure barrel pin 210 to an interior surface of the portable safe by passing through an opening in the bottom of back plate 200 to be secured into a receiving hole comprising matching female thread in barrel pin 210. It is to be understood and appreciated that there exists equivalent means for mechanical attachment of barrel pin 210 to the interior structure of the portable safe of the invention, and that the invention is not to be construed as limited to only the attachment means depicted in the drawings, as this is but one of many examples of attachment of the barrel pin into the portable safe of the invention. As an example of an alternative means of attachment of the barrel pin 210 into the invention, it is understood that barrel pin 210 may be molded directly into a feature of back plate 200. It can further be seen from FIG. 2 that there may be a plurality of sets of holes in back plate 200 which may be utilized to attach barrel pin 210 to an interior surface of back plate 200. It is thus possible to locate barrel pin 210 at any of these holes, allowing the user to configure the barrel pin of the invention such that it can be utilized for either a left hand or a right-hand draw of a firearm from the interior of the portable safe. This feature increases the adaptability and usability of the portable safe of the invention. Any number of sets of barrel pin mounting holes may be provided in back plate 200 or its equivalent structure, allowing the user to select any desired set of holes for either right-hand or left-hand draw, or to adapt the barrel pin location so as to accommodate different makes and models of firearms, or both. The barrel pin mounting holes may be in the form of round openings, or elongated slots for adjusting the position of barrel pin 210 in order to accommodate firearms of varying shape and size, or may be any other shape as may be dictated by the fasteners used to secure barrel pin 210 to an interior surface of back plate 200.

Still referring to the embodiment depicted in FIG. 2, clip 260 may be attached to an exterior surface back plate 200. Clip 260 may be rotably attached such that it may be rotated into any orientation, allowing the portable safe of the invention to be clipped onto any mounting feature such as a user's belt, waistband, or pocket, or any other mounting feature, and to be rotated into any desired position.

Figure 3:
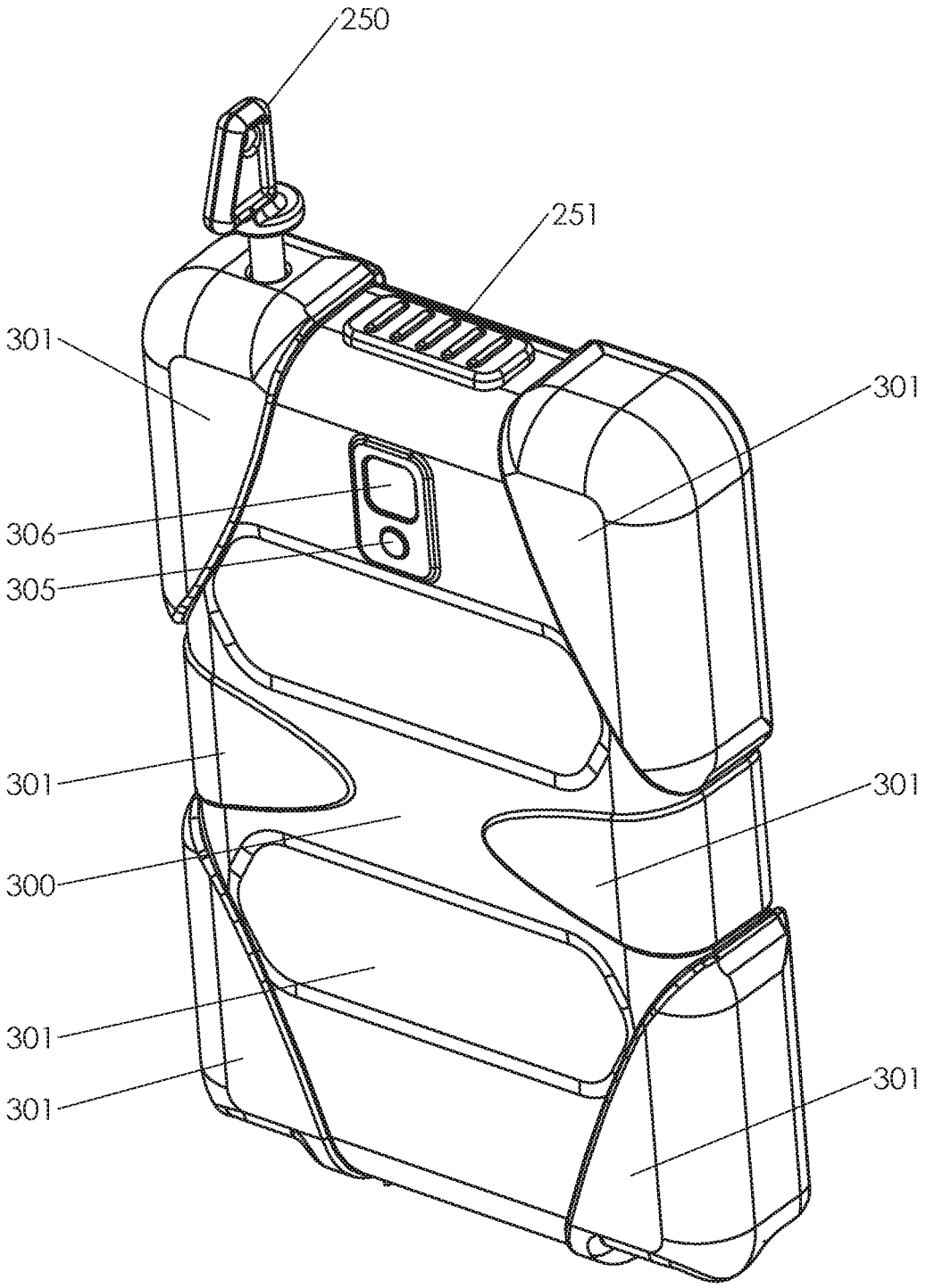
FIG. 3 depicts a front perspective view of an embodiment of the portable safe of the invention in a closed position, in which the first portion and second portions of the safe have been rotated together, forming an interior enclosed volume, showing the faux camera, slide latch, and key of the invention.

Referring now to FIG. 3, a perspective front view of a preferred embodiment of the invention in the closed position is depicted. It can be seen from FIG. 3 that a preferred embodiment of portable safe of the invention is one that has the appearance of a commonly carried inconspicuous container such as, for example, a ruggedized cell phone carrying case. In order to achieve diversion, the appearance of a ruggedized carrying case may be achieved, by the presence of raised surfaces 301 on front cover 300. An outer surface of front cover 300 may further comprise a recess which contains openings 306 and 305 which may further comprise windows to enhance the illusion that the conceal carry container of the invention is a cell phone case. Opening 306 may have the appearance of a cell phone camera window such that it is a faux cell phone camera window; likewise opening 305 may have the appearance of a faux cell phone camera flash. Also depicted in FIG. 3 are key 250 and latch thumb plate 251 which forms part of the mechanical latching mechanism securing the top edge of front cover 300 to the top edge of the back plate 200. In the closed position depicted in FIG. 3, a firearm or other valuable may be enclosed within an enclosed interior volume formed when front cover 300 is rotated against back plate 200 and is latched thereto, providing diversion and concealment of the firearm or other valuable item.

Figure 4:
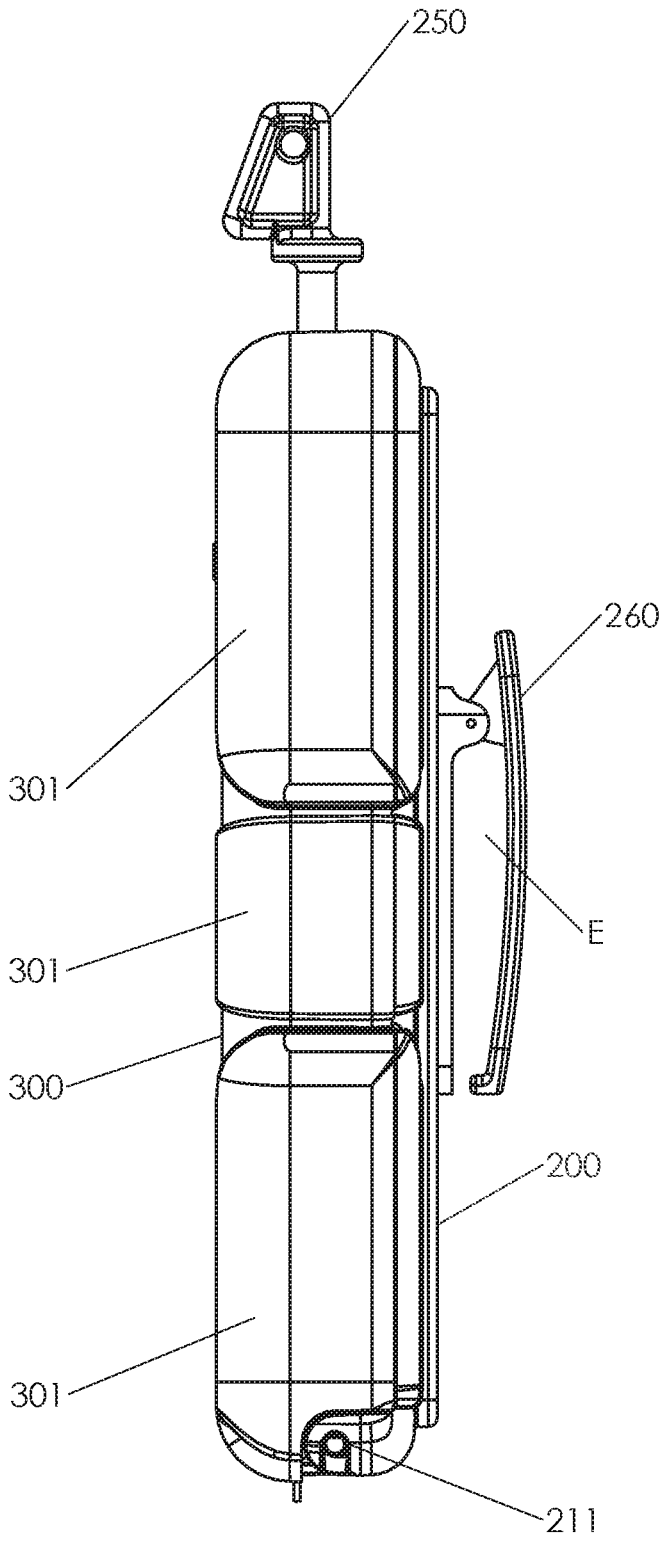
FIG. 4 depicts a side view of an embodiment of the portable safe of the invention in a closed position, in which the first portion and second portions of the safe have been rotated together, forming an interior enclosed volume, and showing a key inserted into a mechanical lock of the invention.

Referring now to FIG. 4, a side view of a preferred embodiment of the portable safe of the invention in a closed position is depicted. Front cover 300 may comprise raised areas 301 to mimic the appearance of a ruggedized cell phone case for the purpose of diversion and concealment. Key 250, which may be used to lock the latching mechanism so that it is not possible for an unauthorized person to access the interior of the portable safe of the invention, is also depicted as inserted into the lock. Clip 260 may be utilized to attach the portable safe of the invention to any structure such as the belt of the user, a user's waistband, or a user's pocket by inserting mounting structure from any of these receiving structures, or any other structure to which it is desired to attach the portable safe of the invention, into the area depicted as area E between that interior surface of the spring-loaded clip 260 and the outer rear surface of the back plate 200. Front cover 300 and back plate 200 may be rotatably attached by the insertion of hinge pin 211 into receiving cylindrical structures on the bottom edge of both front cover 300 and back plate 200, as hereinbefore described. It can be seen from the side view that the portable safe of the invention may easily be removably attached to the belt, waistband, pocket, or any other structure of a user's clothing, or to any other mounting structure, such that a firearm enclosed within the portable safe may be easily accessed when the container is opened. In the closed position depicted in FIG. 4, a firearm or other valuable may be enclosed within an interior volume formed when front cover 300 is rotated against back plate 200 and is latched thereto, providing diversion and concealment of the firearm or other valuable item.

Figure 5:
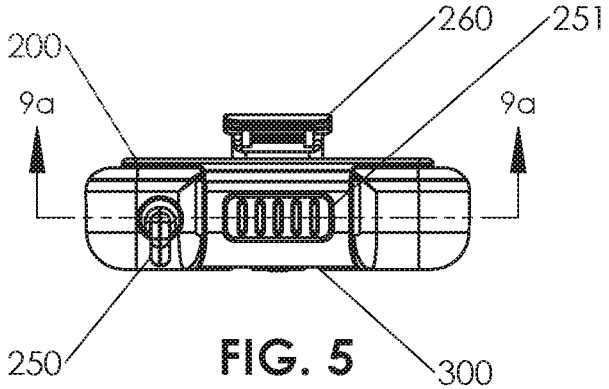
FIG. 5 depicts a top view of an embodiment of the portable safe of the invention in a closed position, in which the first portion and second portions of the safe have been rotated together, forming an enclosed volume.

Referring now to FIG. 5, a top view of a preferred embodiment of the portable safe of the invention in a closed position is depicted. Latch thumb plate 251 is shown on a top surface of front cover 300. Front cover 300 and back plate 200 may be latched together by operation of the latch mechanism such that a firearm secured in the interior space of the portable safe of the invention is concealed from public view. Key 250 is shown inserted into the lock such that it may be turned to lock or unlock the latch mechanism. In an unlocked state, latch thumb plate 251 may be motivated in the direction of the arrow C (depicted in FIG. 6) depicted in the diagram so as to unlatch front cover 300 from back plate 200, allowing portable safe of the invention to open so that the firearm or other valuable item stored in the enclosed volume formed by the rotating of front cover 300 against back plate 200 may be accessed. Clip 260, which may attach portable safe of the invention to a belt, waistband, pocket, or in the other feature is desired by a user, is also depicted in FIG. 5.

Referring now to FIG. 6, a front view of an embodiment of the portable safe of the invention in a closed position and further showing the movement of the slide latch mechanism, and showing key 250 inserted into lock of the invention, is depicted. Latch thumb plate 251, which may be motivated in the direction of arrows C in order to unlatch the latch mechanism so as to allow front cover 300 to rotate away from back plate 200 on hinge pin 211 is also depicted. It can be seen from FIG. 6 that the exterior of the portable safe of the invention may be configured to appear to be a commonly carried item, such as, for example, a ruggedized cell phone case. In order to further aid in the appearance of the portable safe as being a cell phone case, recess 308 may be disposed on an outer surface of front cover 300, and may further comprise faux cell phone camera lens 306 and faux cell phone camera flash 307, which both may be comprised of openings through front cover 300 or may be simply blind holes or indentations in front cover 300, and may further comprise circular plastic pieces bonded into said openings, blind holes or indentations so as to mimic the window of a cell phone camera lens and the window of a cell phone camera flash. Raised areas 301 may further be present in an outer surface of front cover 300 in order to enhance the appearance of the portable safe of the invention as a commonly carried item such as a ruggedized cell phone case.

Figure 7A:
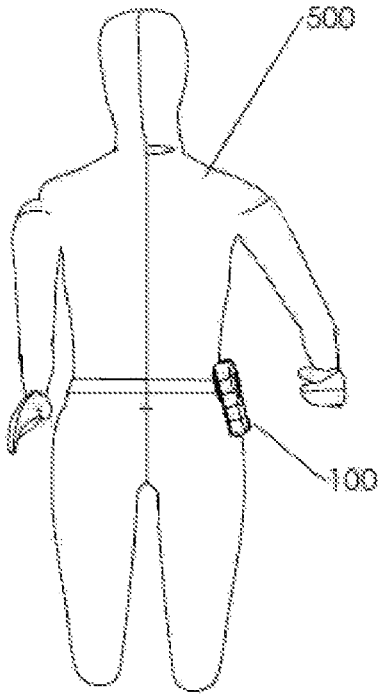
FIG. 7A depicts a user of the invention carrying the portable safe of the invention in a closed position as would be clipped onto a belt, clipped onto a waistband or clipped onto a pocket of the user.
Figure 7B:
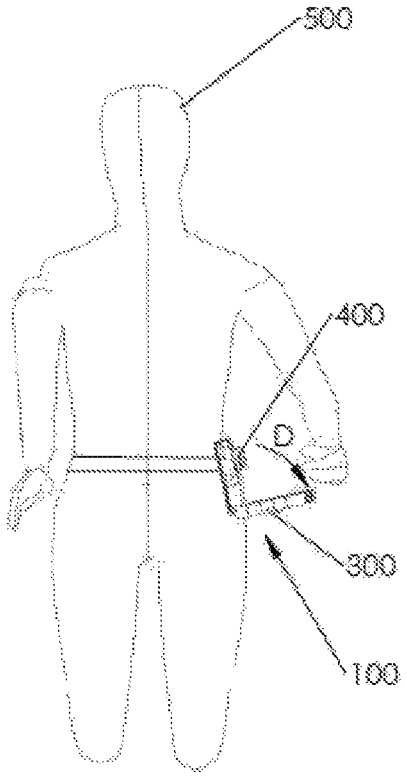
FIG. 7B depicts a user of the invention carrying a portable safe of the invention attached to, for example a belt, waistband or pocket of the user, in which the first portion and second portion of the portable safe of the invention have been rotated into an open position, exposing a firearm carried inside the portable safe of the invention, and allowing it to be removed.

Referring now to FIGS. 7A and 7B, the portable safe of the invention is depicted as being worn by a user 500. In the particular use depicted in FIGS. 7A and 7B, the user 500 has releasably attached a portable safe of the invention 100 onto a belt worn around the user's waist. The releasable attachment of the invention onto a belt worn around the waist may be achieved by the use of clip 260 (not depicted in FIGS. 7A and 7B) being clipped around the belt of the user such that the belt passes through the clip. In FIG. 7A, the portable safe of the invention 100 is depicted in a closed position. In FIG. 7B, the portable safe of the invention is depicted in an open position, with front cover 300 unlatched and rotated into the open position exposing firearm 400 such that firearm 400 may be easily accessed for self-defense or other uses.

Figure 8A:
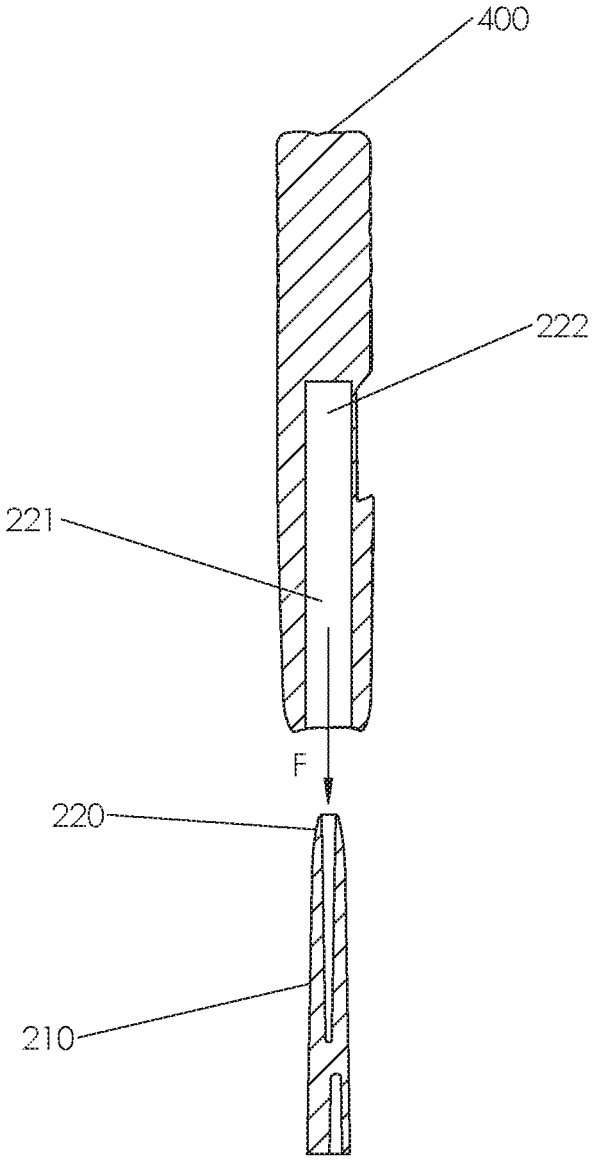
FIG. 8A depicts a cross-sectional view of the barrel pin of the invention as it would be inserted into a firearm to be carried inside the portable safe of the invention, showing the barrel of a firearm moving onto the barrel pin of the invention in a sliding engagement so as to retain the firearm inside the portable safe of the invention.
Figure 8B:
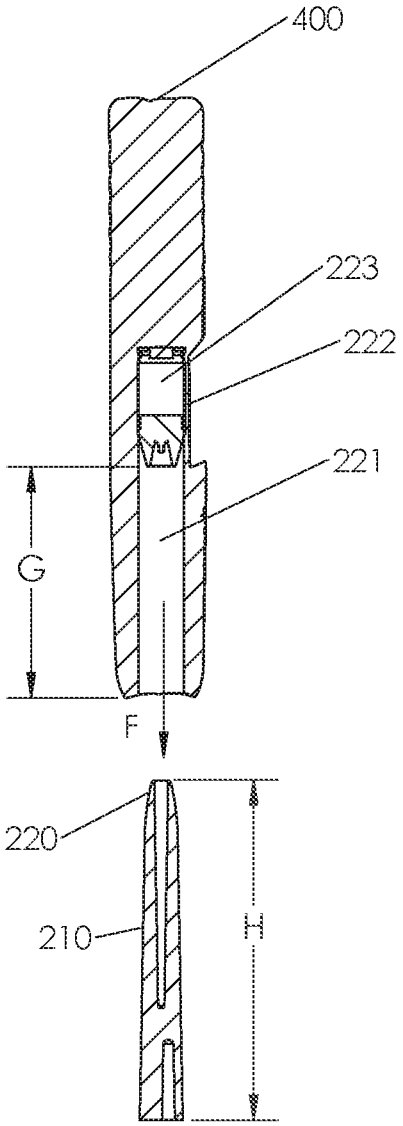
FIG. 8B depicts a cross-sectional view of an embodiment of the barrel pin of the invention as it would be inserted into a firearm to be carried inside the portable safe of the invention, showing the barrel of a firearm moving onto the barrel pin of the invention in a sliding engagement so as to retain the firearm inside the portable safe of the invention, in which the barrel pin length prevents a firearm with an ammunition round loaded into its chamber from being slidingly engaged onto the barrel pin of the invention.

Referring now to FIGS. 8A and 8B, a cross-sectional view of barrel pin 210 being inserted into the barrel 221 of a firearm 400 in a sliding engagement is depicted. It is to be noted that a particular feature of the invention, in a preferred embodiment, is that the length H of barrel pin 210 is sufficient to protrude into the chamber 222 of firearm 400 sufficiently to prevent firearm 400 from being fully slidingly engaged onto barrel pin 210 in the direction of arrow F if an ammunition round 223 is loaded into the chamber 222 of the firearm 400. "Fully slidingly engaged" means that the barrel 221 of firearm 400 is slidingly engaged with barrel pin 210 such that a portion of firearm 400 does not interfere with and prevent the rotating of front cover 300 against back plate 200 into a closed position as hereinbefore described. This optional safety feature requires that only firearms that do not have an ammunition round 223 in the chamber may be slidingly engaged onto the barrel pin 210 of the invention to a fully seated position. Thus in this alternate embodiment, barrel pin length H is greater than the length G of open barrel when an ammunition round 223 is present in chamber 222 of firearm 400. Length G is defined as the length of open barrel of firearm 400 from the tip of the barrel to the tip of an ammunition round 223 that has been loaded into chamber 222 of firearm 400. This eliminates the possibility that firearm 400 may accidentally discharged while being carried in the portable safe of the invention. Barrel pin 210 may further comprise an optional tapered section 220 disposed on the tip of barrel pin 210 to aid in the insertion of barrel pin 210 into barrel 221 of firearm 400.

Figure 9A:
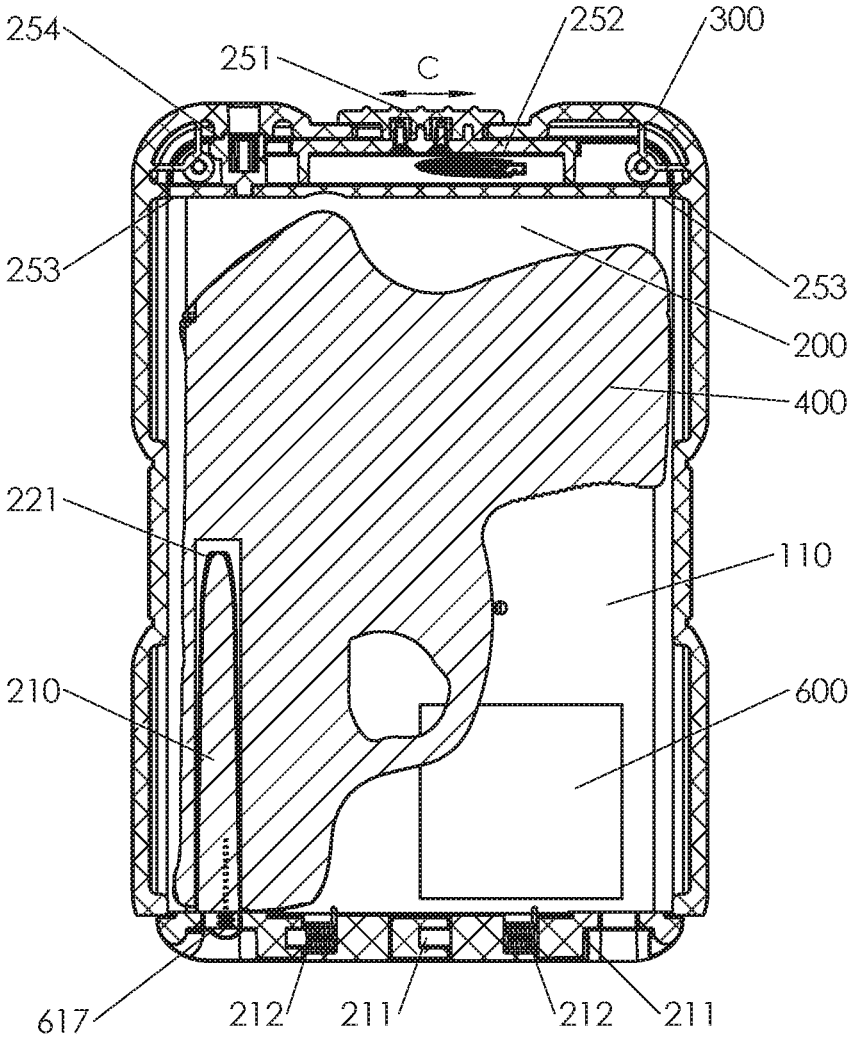
FIG. 9A depicts a cross-sectional view an embodiment of the portable safe of the invention in which a firearm has been placed inside the portable safe by engaging the barrel of the firearm and a sliding engagement onto the barrel pin of the invention.

Referring now to FIG. 9A, a cross-section of an embodiment of the portable safe of the invention is depicted in which a firearm 400 has been secured inside the enclosed volume 110 of a portable safe of the invention by the sliding engagement of barrel pin 210 into barrel 221 of firearm 400. Firearm 400 does not have an ammunition round loaded into its chamber. Latch thumb plate 251 may be motivated in the direction of arrows C (shown in FIG. 6) in order to open the latch mechanism which is further comprised of first slide plate 252, slide cover 253, and latch spring 255 (shown in FIG. 9B). The lock mechanism comprises lock 254 which, when engaged, prevents a user from motivating latch thumb plate 251 and placing the latch into an unlatched position. Hinge pin 211 may protrude through and be received by cylindrical openings in the lower edge of front cover 300 and rear plate 200, and may also protrude through torsion springs 212, to form a hinged engagement between front cover 300 and rear plate 200 along their bottom edges. At least one torsion spring 213 operate to cause front cover 300 to rotate away from back plate 200 when the latch mechanism is caused to open by the motivation of latch thumb plate 251 in the direction of arrow C. The portable safe of the invention may optionally include a GPS tracking device 600 which may be attached to any interior surface but is preferably attached to an interior surface of back plate 200 and may comprise a satellite GPS receiver, controller, battery, non-transitory computer readable storage medium, and wireless transceiver, all in electrical communication with one another. The wireless transceiver may be configured for communication with a wireless network such as a cellular data network, a Wi-Fi network, Bluetooth or any other radio frequency network, such that the GPS receiver is in communication with a remote computer, server, cell phone, laptop, tablet other computing device so that GPS location data received through the GPS receiver may be transmitted to a remote server, computer, or other device allowing a remote user to track the location of the portable safe. The battery may be rechargeable through an external port which may be a USB or other port. The GPS transceiver may be in wireless data communication with a GPS satellite or satellites. The non transitory computer readable medium, which is in electrical data communication with the controller, may contain software instructions for instruction the controller to receive GPS geolocation information from the GPS satellite receiver, store and said GPS geolocation information, and transmit said GPS geolocation information to a remote user through a wireless interface.

Figure 9B:
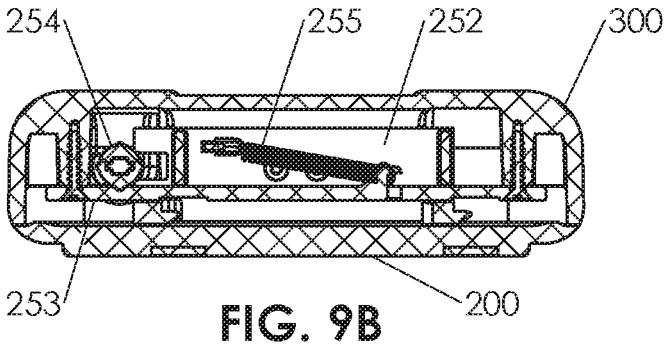
FIG. 9B depicts a cross-sectional view an embodiment of the portable safe of the invention in a closed position, showing the relationship between the components of an embodiment of the lock mechanism.

Referring now to FIG. 9B, a cross-sectional view of an embodiment of the portable safe of the invention and showing the relationship between the components of an embodiment of the lock mechanism is depicted. The latch mechanism of the invention comprises first slide plate 252, slide cover 253, and latch spring 255. The lock mechanism comprises lock 254 which, when engaged, prevents a user from motivating latch thumb plate 251 (not shown in FIG. 9B but shown in FIG. 9A) and placing the latch into an unlatched position. Key 250 (not shown in FIG. 9B but shown in FIG. 2) may be inserted into lock 254 such that when key 250 is rotated into a locked position, lock 254 prevents the operation of the latch mechanism into an unlocked state. When key 250 (not shown in FIG. 9B) is rotated into an unlocked position, the operation of the latch mechanism into an unlatched state is enabled. Thus, when unlocked, latch thumb plate 251 may be motivated to unlatch front cover 300 from back plate 200, allowing front cover 300 to rotate away from back plate 200 on hinge pin 211 (not shown in FIG. 9B) as may be caused by at least one torsion spring 213.

Figure 10:
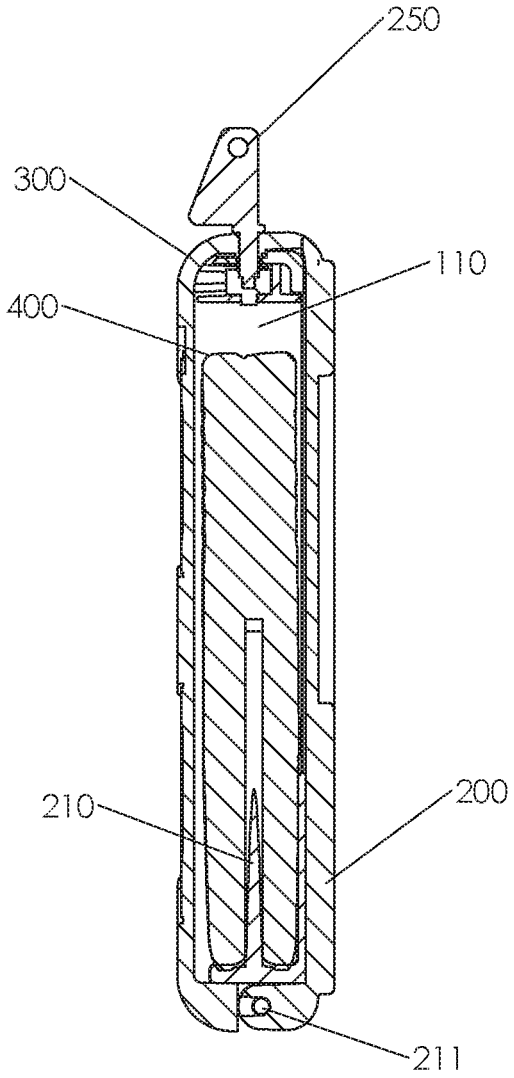
FIG. 10 depicts a cross-sectional view of the portable safe of the invention in a closed position creating an enclosed volume, carrying a firearm in the enclosed volume, the barrel of the firearm having been slidingly engaged with the barrel pin of the invention, securing the firearm inside the portable safe, and further showing a key of the invention inserted into the lock of the invention.

Referring now to FIG. 10, a further cross-sectional view of the invention is depicted in which key 250 has been inserted into lock 254. In the view shown in FIG. 10, the portable safe of the invention has been placed in a closed position by the rotation of front cover 300 against back plate 200, forming enclosed volume 110. Front cover 300 is latched on to rear plate 200 by rotating front cover 300 against rear plate 200 on hinge pin 211. Firearm 400 is slidingly engaged as hereinbefore described onto barrel pin 210, securing firearm 400 into the enclosed interior volume 110 of the closed portable safe of the invention, concealing the firearm from public view but allowing quick and easy access by operation of the latch mechanism here before described when the portable safe of invention is unlocked.

Figure 11:
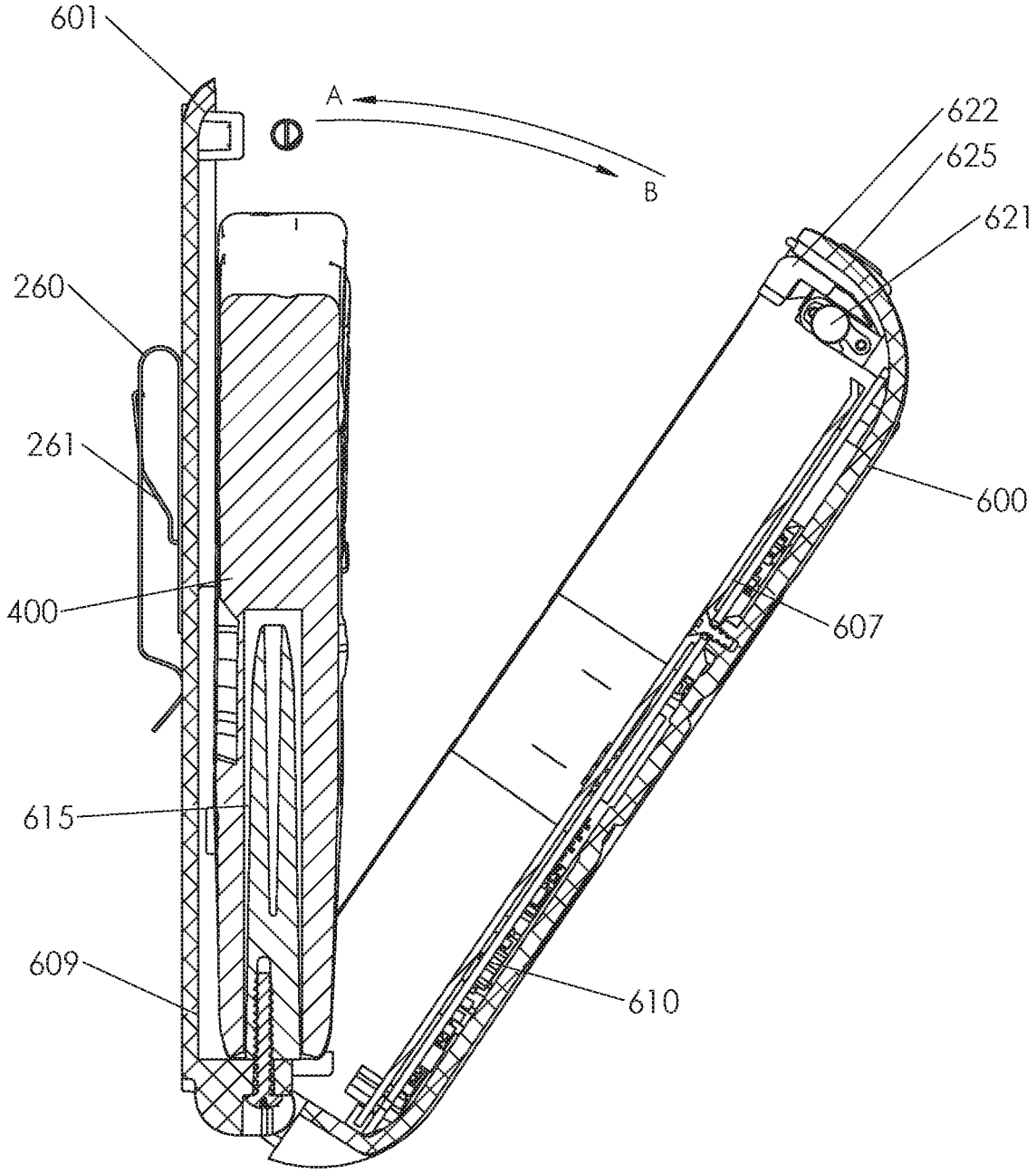
FIG. 11 depicts a cross-sectional view of an embodiment of the invention showing the first portion and second portion of the portable safe of the invention rotating into an open position, with a firearm having been slidingly engaged with the barrel pin of the invention, securing the firearm inside the portable safe.

Referring now to FIG. 11, a cross-sectional view of an electronic second embodiment of the invention showing the portable safe of the invention in a partially open position with a firearm 400 placed inside the container is depicted. Also depicted are arrows A and B which indicate the closing and opening, respectively, of the portable safe of the invention. Arrow A depicts the front cover 600 of an electronic embodiment of the invention rotating into a closed position from an open position; arrow B depicts the front cover 600 of an electronic embodiment of the invention rotating into an open position from a closed position. The electronic second embodiment of portable safe of the invention may comprise a first portion such as, for example, back plate 601 hingedly and rotably attached to a second portion, such as, for example, front cover 600 using, for example, hinge pin 602 (not shown in FIG. 11 but shown in FIG. 12) which may be an elongated cylindrical pin comprised of metal or any other rigid material suitable for acting as a hinge pin and received in a hinged engagement by receiving cylindrical structures in the bottom edge of front cover 600 and back plate 601601 in the same manner as hinge pin 211 shown in FIGS. 1 and 2. In FIG. 11, the portable safe of the invention is shown with front cover 600 rotating into an open position in the direction of arrow B, allowing quick and easy access to firearm 400. In this open position, a user may access a firearm 400 for use in emergency or self-defense situations, or in any other situation in which it is desired to access firearm 400. Operating the slide latch mechanism located on a top surface of front cover 600 into an unlatched position disengages front cover 600 from back plate 601 along the top edge of the portable safe, which is a an edge opposing the edge comprising the rotable hinged connection about hinge pin 602, allowing front cover 600 to rotate away from back plate 601 in the direction of arrow B. Alternatively, front cover 600 may be rotated on hinge pin 602 from an open position, as depicted in FIG. 1, to a closed position along the direction of arrow A. As front cover 600 rotates into a closed position in the direction of arrow A, it may come into contact with back plate 601, whereupon the latch mechanism engages to securely attach the top edge of front cover 600 the top edge of the back plate 601 in a closed position. Motor 621, latch slide plate 622 and locking spacer 623 are shown for reference.

Still referring to FIG. 11, a firearm 400, which may be any type of firearm, may be placed onto barrel pin 615 by means of a sliding engagement between the outer diameter of barrel pin 615 and the inner diameter of the barrel 221 of the firearm. Barrel pin 615 may slide into the barrel 221 firearm 400 in a fit that may be a loose sliding engagement or any other sliding engagement. Optional barrel pin 615 may be, but is not necessarily, comprised of plastic material, which may be molded, printed using additive manufacturing technology, machined, cast, or manufactured by any method known in the art for fabricating plastic material. Barrel pin 615 may also be comprised of metal, phenolic or any other material suitable for retaining a firearm by the sliding engagement of barrel pin 615 into barrel 221. Barrel pin 615 is preferably tapered at least on the end that protrudes into barrel 221 of firearm 400. A latch comprising latch thumb plate 625, latch slide plate 622, and locking spacer 623 (shown in FIG. 12) operate to latch front cover 600 against back plate 601 when the portable safe is in a closed position (the closed position is not depicted in FIG. 1 but is depicted in FIGS. 3, 4, and 5).

Still referring to FIG. 11, the portable safe of the invention may comprise a clip 260 and tang 261 that may be spring-loaded and attached to a back surface of the back plate 601 of the invention as is known in the art, for example, threaded fasteners, chemical bonding, and the like. Clip 260 may be rotatably engaged with a back surface of back plate 601, allowing the portable safe of the invention to be oriented at any angle relative to the mounting structure to which it may be removably attached. Clip 260 may be spring-loaded such that it is releasably attachable to a receiving structure such as, for example, a belt of a user, a pocket of a user, the waistband of a user's pants, or any other structure able to accept clip 260.

Figure 12:
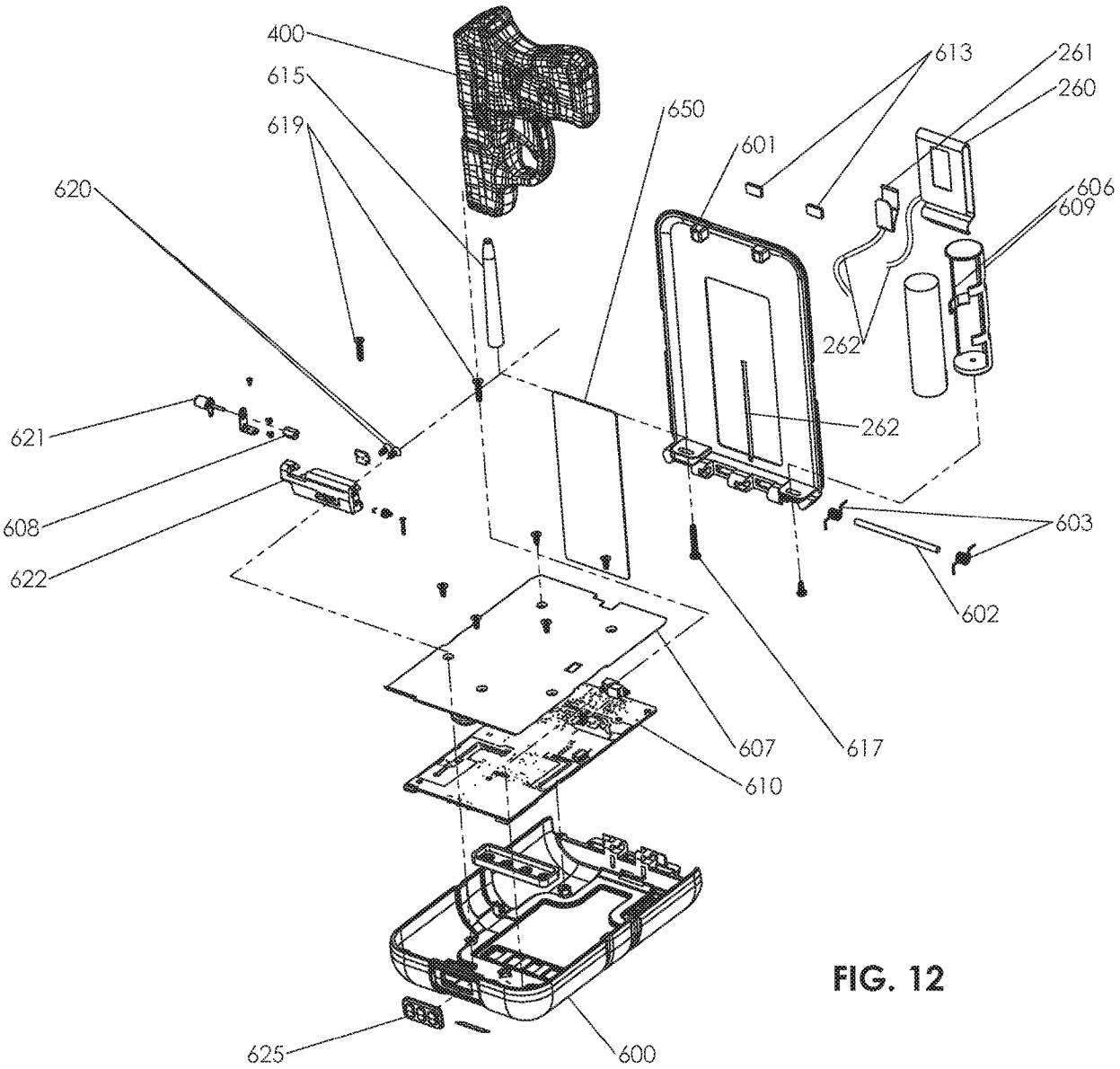
FIG. 12 depicts an exploded view of an electronic second embodiment of the portable safe of the invention in an open position, indicating the manner in which the various components of the invention are assembled together and showing the placement of a firearm onto the barrel pin of the invention by sliding engagement between the firearm barrel and the barrel pin of the portable safe.

Referring now to FIG. 12, an exploded view of an electronic embodiment of the portable safe of the invention in an open position is depicted, indicating the manner in which the various components of this embodiment of the invention are assembled and operate together. Front cover 600 is rotatably engaged with back plate 601 along a bottom edge of both front cover 600 and back plate 601. The rotatable hinged engagement between back plate 601 and front cover 600 is established by hinge pin 602 which is received by alternating receiving cylindrical structures disposed along the bottom edge of each of front cover 600 and back plate 601. At least one torsion spring 603 which may comprise tangs that may surround portions of the cylindrical outer diameter of hinge pin 602, with said tangs placed against a surface of each of front cover 600 and back plate 601 so as to provide an opening pressure tending to cause front cover 600 to rotate away from back plate 601 on hinge pin 602 when front cover 600 is not latched into place against back plate 601 by the latch comprising latch slide plate 622, latch thumb plate 625, and latch spring 627 (shown in FIGS. 14 and 15). Motor 621, which is part of the electromechanical lock, is also depicted. In this embodiment, at least one torsion spring 603 operates to a apply a force to bias front cover 600 such that it tends to rotate away from back plate 601 and into and remain in a fully open position as long front cover 600 is not latched against back plate 601, in other words, when the latch of the invention is in an unlatched position. Latch thumb plate 625 is attached to latch slide plate 622 by fasteners 620.

Still referring to FIG. 12, optional barrel pin 615 may be attached to an interior surface and may be disposed in such a position as to allow a sliding engagement with the barrel of a firearm 400, so that front cover 600 may be rotated into a closed position against back plate 601 and latched there by operation of the latch, forming an interior enclosed volume that is able to accept firearm 400 while in the closed position and thereby concealing firearm 400 from view. Fastening hardware such as, for example, a male threaded fastener 617 may be utilized to removably attach optional barrel pin 615 to an interior surface of the portable safe by passing through an opening in the bottom of back plate 601 to be secured into a receiving hole comprising matching female threads in barrel pin 615. It is to be understood and appreciated that there exists equivalent means for removable or non-removable attachment of barrel pin 615 to the interior structure of the portable safe of the invention, and that the invention is not to be construed as limited to only the attachment means depicted in the drawings, as this is but one of many examples of attachment of the barrel pin into the portable safe of the invention. As an example of an alternative means of non-removable attachment of the barrel pin 615 into the invention, it is understood that barrel pin 615 may be molded directly into a feature of back plate 601. It can further be seen from FIG. 12 that there may be a plurality of holes in back plate 601 which may be utilized to attach barrel pin 615 to an interior surface of back plate 601. It is thus possible to locate barrel pin 615 at any of these holes, allowing the user to configure the barrel pin of the invention such that it can be utilized for either a left hand or a right-hand draw of a firearm from the interior of the portable safe. This feature increases the adaptability and usability of the portable safe of the invention. Any number of sets of barrel pin mounting holes may be provided in back plate 601 or its equivalent structure, allowing the user to select any desired set of holes for either right-hand or left-hand draw, or to adapt the barrel pin location so as to accommodate different makes and models of firearms, or both. The barrel pin mounting holes may be in the form of round openings, or elongated slots for adjusting the position of barrel pin 615 in order to accommodate firearms of varying shape and size, or may be any other shape as may be dictated by the fasteners used to secure barrel pin 615 to an interior surface of back plate 601.

Still referring to FIG. 12, in an embodiment clip 260 may comprise a tang 261 which may be in electrical contact with clip 260 when clip 260 is not removably attached to a receiving structure such as, for example, a belt worn by a user. When clip 260 is removably attached to a receiving structure such as, for example, a belt worn by a user, tang 261 and clip 260 may be in electrical contact, closing an electric circuit comprising wires 262 which may be in communication with controller 800. Thus, clip 260, tang 261 form a clip sense circuit in communication with controller 800, and controller 800 may use the closed circuit resulting from clip 260 not being removably attached to a receiving structure as a clip sense signal indicating that the portable safe has been removed from a receiving structure. Likewise, controller 800 may use the open circuit resulting from clip 260 being removably attached to a receiving structure as a clip sense signal indicating that the portable safe has been removably attached to a receiving structure. Clip 260 may be rotated into any position, allowing the portable safe of the invention to be clipped onto any mounting feature such as a user's belt, waistband, or pocket, or any other mounting feature, and to be rotated into any desired position.

Still referring to FIG. 12, an electronic embodiment of the portable safe of the invention may comprise electronics assembly 610 which may be attached to an interior surface of front cover 600 by mounting hardware which may be, for example, threaded fasteners passing through clearance holes in electronics assembly 610 and being received by matching female threaded holes located in an interior surface of front cover 600. Electronics assembly 610 may comprise a printed wiring board or printed circuit board of any material known in the printed circuit board art upon which various electronic components of the electronic embodiment of the portable safe may be mounted and electrically connected. Electrical connectivity between the various electrical and electronic components of the portable safe may be accomplished by discrete wiring, printed circuit board wiring, or any other electrical connection means known in the electrical arts. The electrical and electronic components mounted on to the printed circuit card or printed wiring board electronics assembly 610 may comprise any of the electronic or electrical components depicted in the electrical block diagram depicted in FIG. 24, which components may include controller 800, accelerometer 801, GPS tracking transceiver and its associated antenna 802, near field communication transceiver 803, near field communication antenna 804, real-time clock 805, wireless transceiver 806, RF antenna 821, push-button 807, battery charger and power conditioning circuitry 808, battery or batteries 606, motor driver circuitry 809, speaker 820, non transitory computer readable medium 810, and any other electrical or electronic components of the invention as described herein or depicted in FIG. 24 and their equivalents. Battery or batteries 606 may be in electrical communication with all of the active electrical components mounted on electronics assembly 610 so as to supply electrical power to them as is known in the art by. Battery or batteries 606 may be retained within a battery holder 609 for protection and ease of replacement. Alternatively, battery or batteries 606 may be mounted directly onto an interior surface of the back plate 601 or may be mounted in the portable safe of the invention by any means known in the art. Electronics assembly 610 may be covered by an electronics assembly cover plate 607, which may be attached to an interior surface of front cover by any means known in the art. Cover 650 may cover clip sense wires 262.

Still referring to FIG. 12, one or more covers 613 may be utilized to cover recesses located in an outer surface of back plate 601 so as to prevent unauthorized tampering with the portable safe of the invention.

Figure 13:
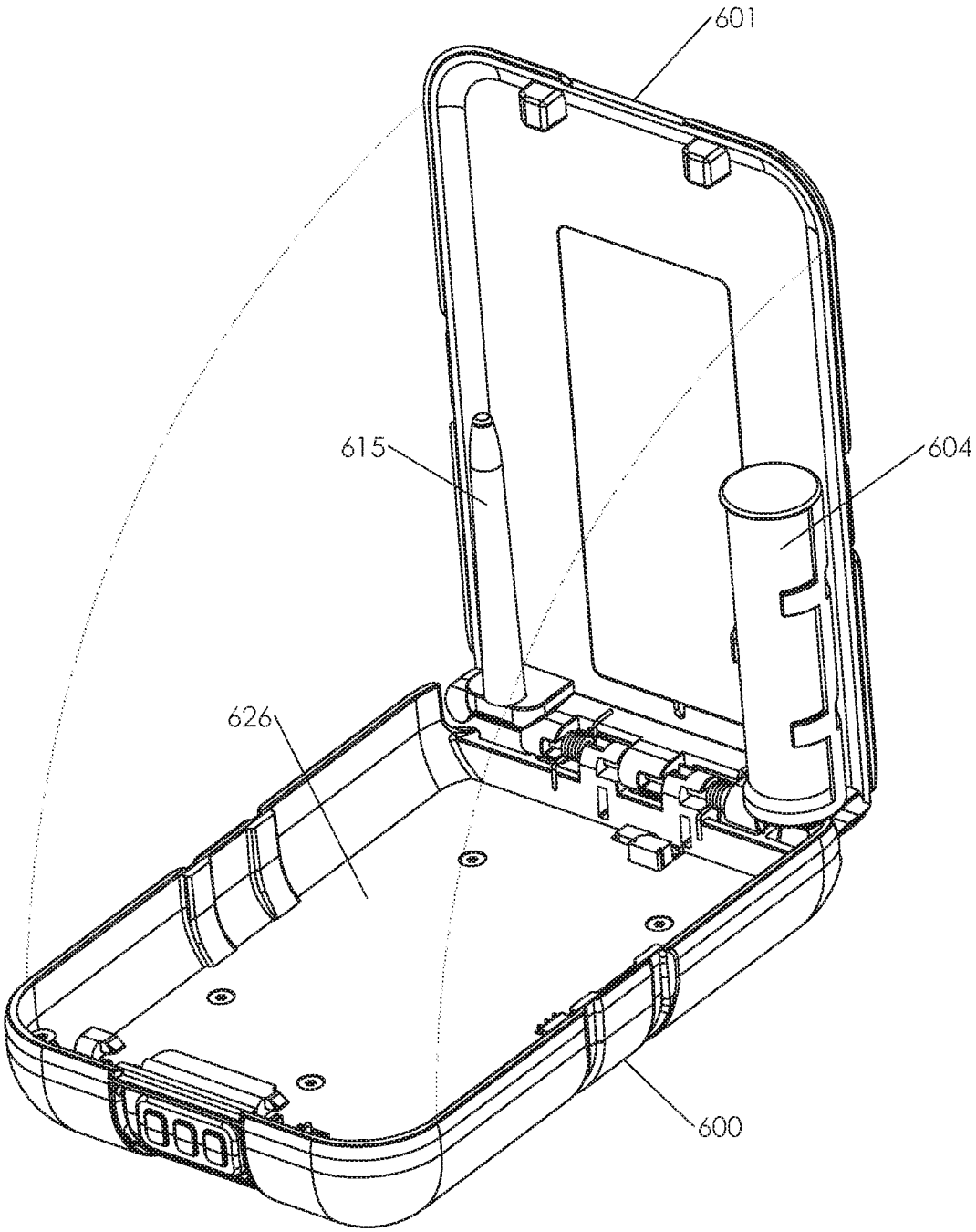
FIG. 13 depicts a perspective view of an electronic second embodiment of the invention, the first portion and second portion having been rotated into an open position.

Referring now to FIG. 13, a perspective view of an embodiment of the invention in an open position is depicted. In the open position, back plate 601 is rotated away from front plate 600 allowing a user access to the interior of the portable safe of the invention. Optional barrel pin 615, which may be removably attached to a surface of, or a structure attached to, back plate 601, may be used to retain a firearm by a sliding engagement with the barrel of the firearm as is hereinbefore described; however, in embodiments of the portable safe of the invention which are not intended for use with firearm, barrel pin 615 may be not be present. For example, when the intended use of a portable safe of the invention is to carry valuables such as medications, first aid supplies, money, credit cards, travel or other documents such as passports, or any other valuables, barrel pin 615 may not be present. Electronics assembly cover plate 626 and battery cover 604 are shown for reference.

Figure 14A:
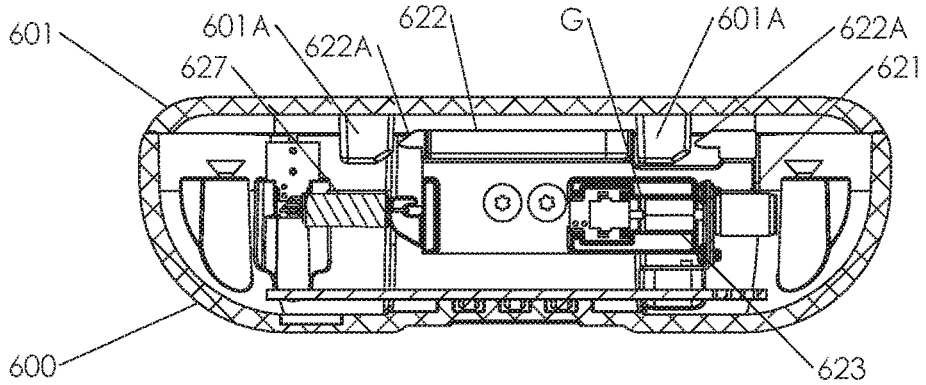
FIG. 14A depicts a top cross sectional view of the portable safe of the invention in a closed position, showing the electromechanical lock mechanism of the second embodiment in an unlocked position, and the latch in an unlatched position.
Figure 14B:
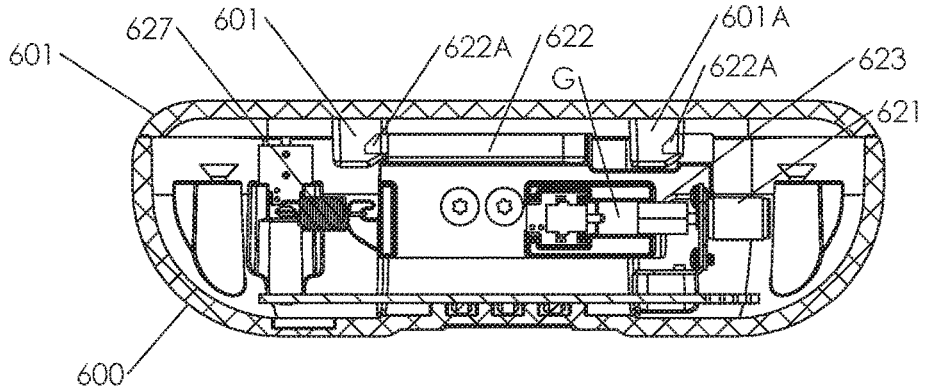
FIG. 14B depicts a top cross sectional view of the portable safe of the invention in a closed position, showing the electromechanical lock mechanism of the second embodiment in an unlocked position, and the latch in a latched position.
Figure 15:
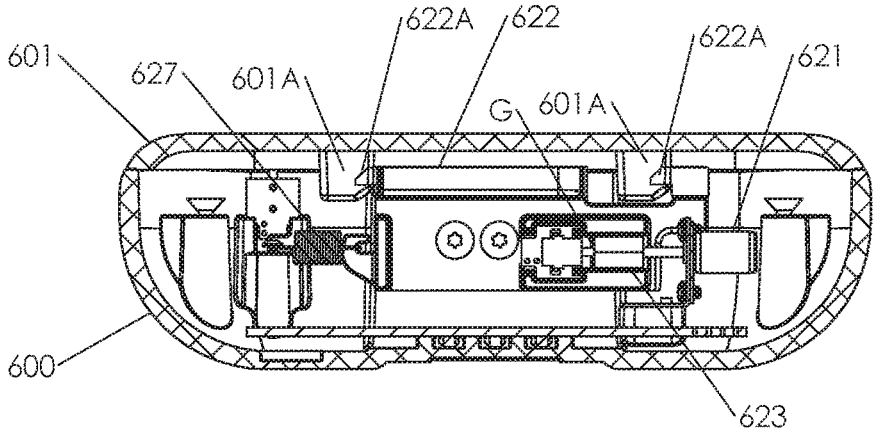
FIG. 15 depicts a top cross sectional view of the portable safe of the invention in a closed position, showing the electromechanical lock mechanism of the second embodiment in a locked position, and the latch in a latched position.

Referring now to FIGS. 14A, 14B and 15, the operation of the latch and electromagnetic lock of an embodiment of the portable safe of the invention is depicted. FIGS. 14A, 14B and 15 provide cross-sectional top views of the portable safe of the invention in a closed position, in various combinations of the electromagnetic lock being locked or unlocked, and the latch being latched or unlatched. When the portable safe of the invention is disposed in the closed position, a first portion, which may be front cover 600, has been rotated into contact with a second portion, which may be back plate 601, as is shown in FIGS. 14A, 14B and 15. In the closed position, first portion front cover 600 and second portion back plate 601 together form an enclosed volume suitable for storing valuables inside the safe of the invention.

Referring now to FIG. 14A, the lock is depicted as unlocked and the latch is depicted as unlatched. While the safe is shown in closed position in FIG. 14A, first portion front cover 600 may be rotated away from second portion 601, because the safe is unlocked and unlatched. Latch slide plate has been motivated into the unlatched position by motivation of the latch thumb plate against the force of latch spring 627, removing slide latch pawls 622A, which are a part of, or attached to, latch slide plate 622, from matching receiving openings located in pawl receiving structures 601A which are attached to, or are a part of, back plate 601. Latch slide plate 622 may be sliding engaged with a latch base plate or other structure attached to or a part of front cover 600. When slide latch pawls 622A are not received by matching receiving orifices located in pawl receiving structures 601A, as is depicted in FIG. 14A, the latch of the invention is unlatched, allowing front cover 600 to rotate away from back plate 601. Pressure on latch thumb plate 625, which is attached to latch slide plate 622, operates against the returning force of latch spring 627 to keep the latch in the unlatched position. Thumb plate 625 may be attached to latch slide plate 622 by any other means known in the mechanical arts. It can be seen that the electromechanical lock, which comprises motor 621 and locking spacer 623, is in the unlocked position wherein locking spacer 623 has been retracted towards motor 621 by the linear actuator operation of motor 621. When locking spacer 623 has been retracted, it allows latch slide plate 622 to be motivated into the unlatched position by allowing latch slide plate 622 to slide towards the unlatched position from the latched position until contact is made at point G, which is sufficient movement of latch slide plate 622 to allow slide latch pawls 622A to be removed from the matching receiving orifices located in pawl receiving structures 601A, as depicted in FIG. 14A.

Referring now to FIG. 14B, the lock is depicted as unlocked and the latch is now depicted as latched. The latch may transition into the latched state from an unlatched state, for example, when pressure on latch thumb plate 625 has been sufficiently released that latch spring 627 operates to pull latch slide plate 622 into the latched position shown in the figure, wherein slide latch pawls 622A are received by matching receiving openings located in pawl receiving structures 601A. In this latched state, first portion front cover 600 may not be rotated away from second portion 601, because latch pawls 622A are captured in the matching receiving openings located in pawl receiving structures 601A which are attached to back plate 601. Furthermore, in FIG. 14B, the lock is depicted in an unlocked state, wherein locking spacer 623 has been retracted towards motor 621 by the linear actuator operation of motor 621, creating a separation G. In this unlocked state, the separation G allows a user to motivate latch slide plate 622 against the force of latch spring 627 into the unlatched state (as depicted in FIG. 14A and described above).

Referring now to FIG. 15, the lock is depicted as locked and the latch is depicted as latched. The latch may be disposed in a latched state as described above in the description provided relative to FIG. 14B, in which latch pawls 622A are captured in the matching receiving openings located in pawl receiving structures 601A. In the locked state depicted in FIG. 15, motor 621 has been commanded to extend locking spacer 623 so that contact is made at point G, which prevents a user from motivating latch slide plate 622 against the force of latch spring 627 into the unlatched state (as depicted in FIG. 14A and described above). Thus, locking spacer 623, which has been extended by the linear actuator operation of motor 621, prevents latch slide plate 622 from being motivated into an unlatched position by a user applying pressure to latch thumb plate 625. When a portable safe of the invention is in the locked and latched state depicted in FIG. 15, front cover 600 cannot be rotated away from back plate 601 by operation of the hinged attachment of front cover 600 to back plate 601 on hinge pin 602 (not shown in FIG. 15) and thus the portable safe of the invention remains in a closed position and the contents of the safe cannot be accessed until the safe is unlocked and the latch is motivated into and unlatched position as hereinbefore described.

Thus the electromechanical lock of the electronic second embodiment of the portable safe may be commanded from a remote user to lock or unlock the portable safe by real time command, or upon a schedule, as determined by the user. The portable safe of the invention, in an embodiment, may operate in any of the following states: 1) locked and latched; 2) unlocked and latched; and 3) unlocked and unlatched. In the locked and latched state, which may be the default state of the safe upon power on, the lock of the safe is in a locked position and the latch of the safe is in a closed position. In the unlocked and latched state, the lock of the safe may be in an unlocked position and the latch is in a closed position. This state is also called a fast access mode, because the safe may be quickly opened by operation of the latch to an unlatched position. In the unlocked and unlatched state, the lock is in an unlocked position and the latch is in an unlatched position, placing the safe in an open condition in which a firearm or other valuable may be retrieved without further operation of a control interface.

DESCRIPTION OF THE FUNCTIONS OF THE ELECTRONIC EMBODIMENTS OF THE INVENTION

The operation of various modes and functions, or methods, of an electronic embodiment of the portable safe of the invention are now described. The various modes and methods of the portable safe of the invention as herein described may be carried out by the execution of computer readable instructions by any device capable of executing computer executable instructions such as, for example, controller 800. The computer executable instructions, which are non-transitory in nature, may be stored in non transitory computer readable medium 810 and retrieved by controller 800 for execution in order to carry out the various modes, functions and methods of the invention as described herein.

Figure 16:
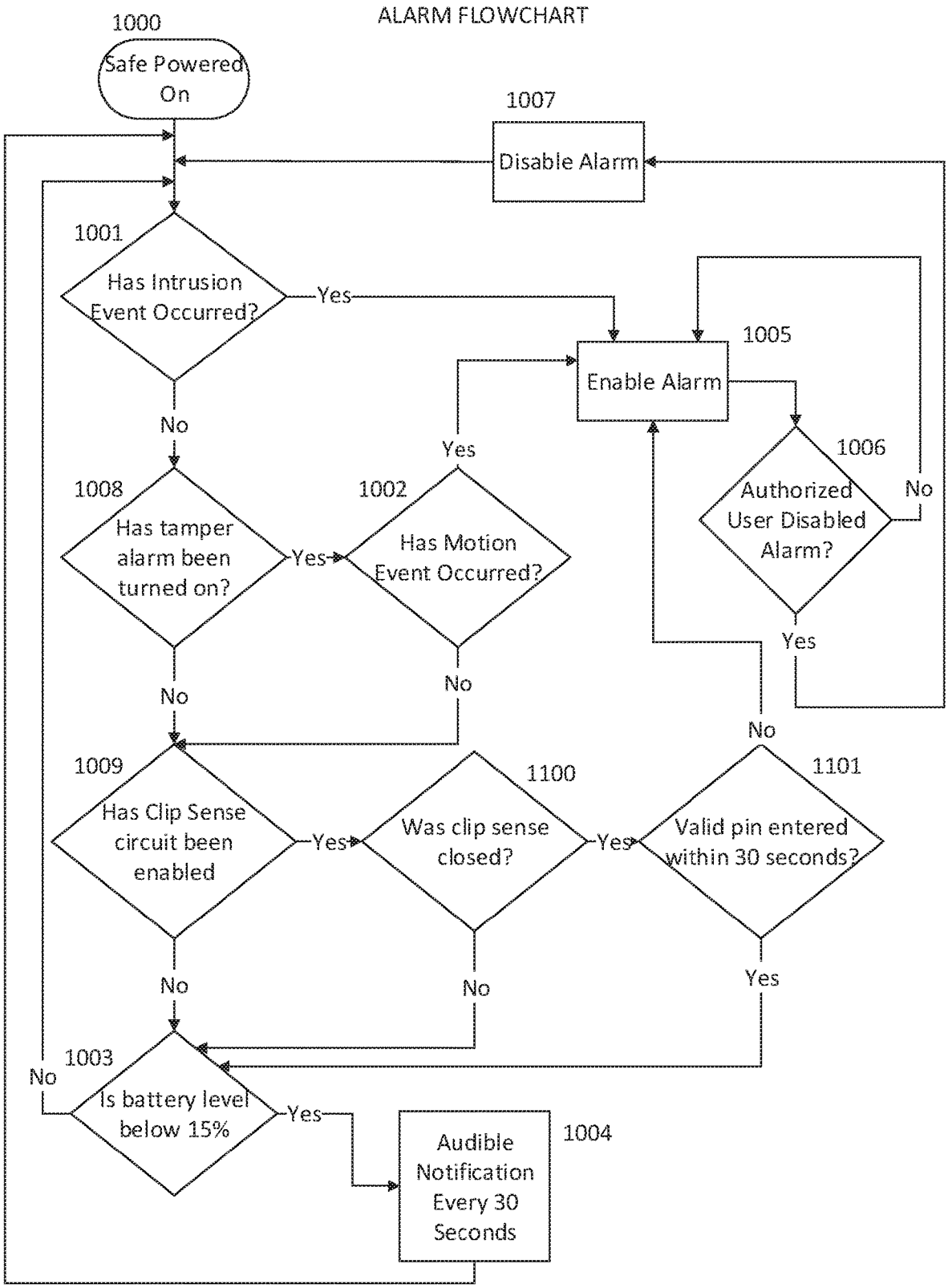
FIG. 16 depicts a flow diagram of one embodiment of an alarm function of an electronic embodiment of the portable safe of the invention.

Referring now to FIG. 16, a flow diagram of one embodiment of an alarm function of an electronic embodiment of the portable safe of the invention is depicted. In a first step 1000, the portable safe of the invention may be in a constant ON state, or may be placed into a powered-on condition by operation of a manual pushbutton 830 (depicted in FIG. 24). Once having powered on, controller 800 may monitor the state of sensors placed within the portable safe to determine whether an intrusion event, such as, for example, unauthorized opening of the portable safe which may be defined as opening of the safe without a proper PIN code having been received, has occurred in step 1001. If it is determined that an intrusion event has occurred an alarm may be operated, step 1005. The alarm may be an audible alarm such as playing a sound through speaker 820 (depicted in FIG. 24), a visible alarm in the form of lighting lights such as LED lights 811-813 (depicted in FIG. 24) which may be placed on any surface of the portable safe of the invention, the transmission of a signal to a remote entity through the remote user data interface of the portable safe, or any combination of these alarms. The transmission of a signal containing alarm information to a remote user through the remote user data interface may be in the form of a cellular text message sent to a predetermined cellular telephone number or other entity capable of receiving a cellular text message. Once the alarm has been operated in step 1005, the safe monitors whether the alarm has been disabled 1005. An authorized user may disable the alarm 1007 by entering a PIN code on pushbuttons 830, causing the portable safe of the invention to be placed into a no-alarm state, whereupon it will return to monitoring whether an intrusion has occurred 1001. If an authorized user has not disabled the alarm, the alarm will continue to operate.

Still referring to FIG. 16, if no intrusion event has occurred 1001, the portable safe of the invention senses whether the tamper alarm has been turned on, step 1008. The tamper alarm may be turned on remotely by receiving signals through wireless interface 806 (depicted in FIG. 24) or may be set by a user by manual operation of pushbuttons 830. If the tamper alarm has been turned on 1008, the safe may interrogate or receive signals from the one or more accelerometers of the invention 801 (depicted in FIG. 24). If the one or more accelerometer signals indicate that a motion event has occurred 1002, such as the at least one accelerometers sensing that the safe has been rotated beyond a predetermined limit, or the accelerometers sensing that the safe has been moved continuously for programmable minimum period of time such as, for example, five seconds, the alarm of the invention may be enabled 1005 and will remain enabled until an authorized user disables the alarm as above described.

Still referring to FIG. 16, if the tamper alarm has not been turned on 1008, or, if it has been turned on but no motion event has occurred 1002, the portable safe of the invention senses whether fast access mode has been enabled 1009. Controller 800 may read the state of registers in non transitory computer readable medium 810 in order to determine whether fast access mode, in which the lock is in an unlocked state and the latch is in a latched state, has been commanded by a user operating pushbuttons 830 and entering, for example, a PIN code and command, or by a remote user transmitting wireless signals to the safe through the remote user data interface. If fast access mode has been enabled 1009, the safe may sense whether the clip circuit through clip first part 260 and clip second part 261 (see FIG. 12) is closed, indicating that the safe has not been placed on a structure such as, for example, the pants belt of a user. If the clip circuit has not been closed 1100, indicating that the safe is located on a receiving structure such as the pants belt of a user, controller 800 may execute a timer for a predetermined programmable period of time 1101, which may be, for example, thirty seconds, and if a valid PIN code is not entered into the safe through pushbuttons 830 prior to the expiration of the predetermined programmable period of time, alarm 1005 may be operated and may be disabled as above described.

Still referring to FIG. 16, if fast access mode has not been enabled, the level of charge of battery 606 (depicted in FIG. 24) is ascertained by controller 800 reading signals from the battery charger and power conditioning circuit 808 (depicted in FIG. 24) to determine if the battery charge level is below a predetermined low-charge threshold, such as, for example, 15% of full charge. If the battery level is below a predetermined low-charge threshold an audible notification will be commanded by controller 800 through speaker 820 (depicted in FIG. 24), for example an audible signal made every 30 seconds such as a beep, until the battery level is returned to a level that is greater than a predetermined low-charge threshold as determined by battery charger and power conditioning circuit 808. A predetermined low-charge threshold and a pre-determined medium-charge threshold may each stored in non-transitory computer readable medium 810 and may therefore be readable by controller 800.

Figure 17:
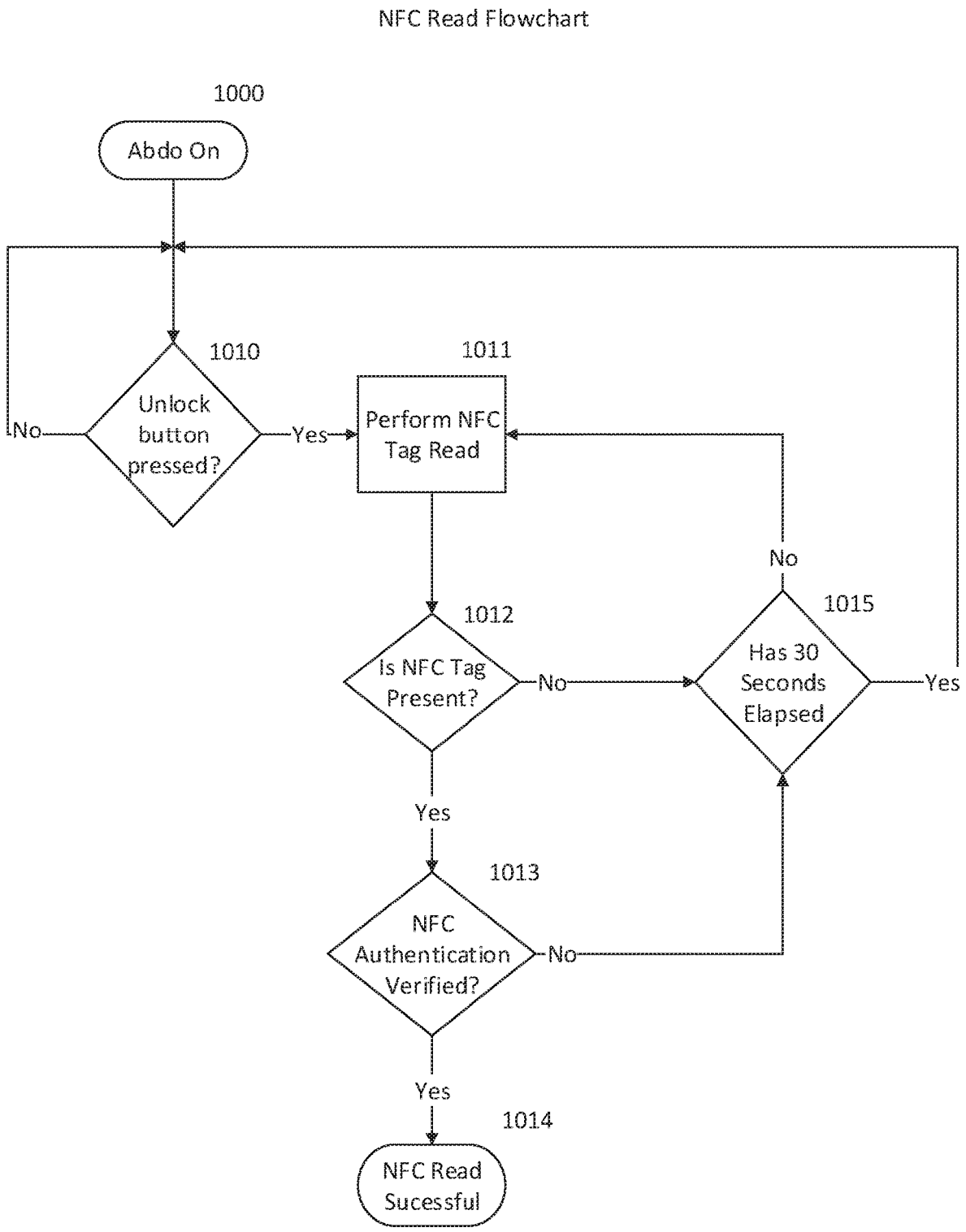
FIG. 17 depicts a flow diagram of one embodiment of a Near Field Communication (NFC) read function of an electronic embodiment of the portable safe of the invention.

Referring now to FIG. 17, a flow diagram of an alternate embodiment of the safe of the invention which utilizes a Near Field Communication (NFC) read function of an electronic embodiment of the portable safe of the invention is described. In a first step 1000, the portable safe of the invention may be placed into a powered-on condition as above described. Once having powered on, controller 800 or other circuitry may monitor the state of a push button of button array 830 (depicted in FIG. 24) to determine whether a user has commanded the safe to unlock, step 1010. If a user has commanded unlock through push button 830, the controller 800 monitors a near field communication transceiver in communication with controller 800 in order to ascertain whether a near field communication tag has been read 1011. If it is determined that a near field communication tag is present 1012, controller 800 executes computer readable instructions to determine whether the near field communication tag is an authenticated tag of an authorized user, step 1013. An authenticated near field communication tag is one that has been predetermined as belonging to an authorized user of the portable safe of the invention, and for which a code has been stored in non transitory computer readable medium 810. If it is determined by controller 800 reading non transitory computer readable medium 810 and executing computer readable instructions that the near field communications tag is that of an authorized user, the controller generates and stores in non transitory computer readable medium 810 a near field communication read successful message 1014. If it is determined by controller 800 executing computer readable instructions that near field communications tag is not that of an authorized user 1013, it determines whether a predetermined, programmable period of time, such as 30 seconds, has elapsed since the near field communication tag read by the near field communication transceiver in step 1015. If the predetermined, programmable period of time has not elapsed, controller 800 returns to step 1011 and performs another near field communication tag read. If the predetermined, programmable period of time has elapsed, controller 800 commands the portable safe of the invention to return to a state wherein it reads whether a push button of button array 830 has been pressed to command unlock, step 1010.

Figure 18:
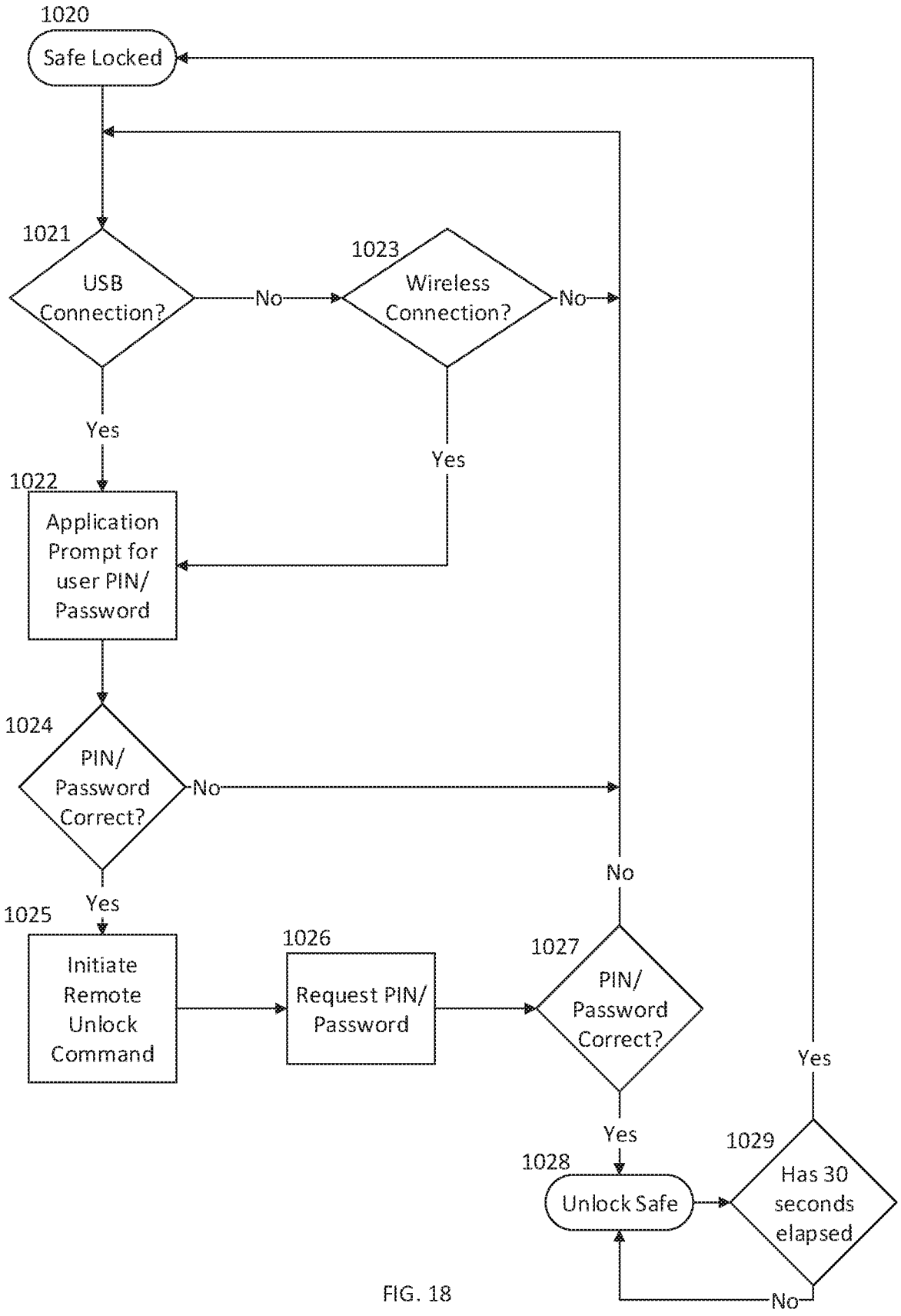
FIG. 18 depicts a flow diagram of one embodiment of a remote unlock function of an electronic embodiment of the portable safe of the invention.

Referring now to FIG. 18, a flow diagram of one embodiment of a remote unlock function of an electronic embodiment of the portable safe of the invention is depicted. In an initial state 1020, the lock of the portable safe of the invention is in a locked condition. The locked condition is defined as a condition in which the latch mechanism, thumb plate 251, may not be operated so as to open the portable safe of the invention. In the locked condition a user is unable to manipulate latch thumb plate 251 (depicted in FIGS. 3, 5, 6 and 9A) so as to open the portable safe of the invention. In a next step 1021, controller 800 reads the state of Universal Serial Bus (USB) port 815 (depicted in FIG. 24) to determine whether there is an active USB connection to a remote device. If there is no active USB connection to a remote device, controller 800 executes non-transitory computer readable instructions to determine in step 1023 whether there is an active wireless connection through wireless transceiver 806 (depicted in FIG. 24) to a remote device such as a laptop computer, smart phone, tablet or tablet computer, smart watch, Internet connection or other wireless connection to a remote device. If it is determined that there is an active USB connection or a wireless connection to a remote device, controller 800 may execute computer readable instructions in to communicate with the connected device and to thereby receive a remote device signal, whether the remote device is connected via USB or wirelessly, whereupon a user using the connected device may be prompted to enter a personal identification number, or PIN, password, or other identifying indicia which may be operative to identify the user and to allow controller 800 to execute instructions in order to determine whether the user is an authorized user. The user may have already provided identifying indicia such as a personal identification number (PIN), password or the like that has been stored in non transitory computer readable medium 810 to facilitate controller 800's execution of instructions to identify whether the user is an authorized user 1024. If the user is determined to be an authorized user by the entry of a correct PIN or password 1024, controller 800 will execute instructions to initiate the remote unlock command 1025 and will again require the remote user to enter a personal identification number, password, or other identifying indicia 1026. If the user again enters correct authenticating identifying indicia (i.e. for the second time) 1027, controller 800 will execute instructions unlocking the electromechanical lock mechanism of the portable safe as hereinbefore described 1028, thus placing the portable safe of the invention in an unlocked condition so that a user may manipulate latch thumb plate 251 as hereinbefore described to open the portable safe 1028 (in other words, the safe is placed into fast access mode). Requiring a user to enter authenticating identifying indicia twice is an optional safety feature that is intended to prevent accidental unlocking of the portable safe by the user. This could happen, for instance, if a user accidentally swipes an "unlock" command on their cell phone touch screen while the portable safe software application is running on the cell phone and the cell phone is in wireless communication with the portable safe of the invention through the remote user data interface. The safe will remain unlocked 1028 for a predetermined, programmable period of time, such as, for example, thirty seconds, and then will return to the locked condition 1029. If the identifying indicia such as personal information number or password are not correct, step 1027, the portable safe of the invention will remain in the locked condition and the process will start again 1021. Thus a remote user may remotely unlock the safe for a predetermined, programmable period of time, such as, for example, thirty seconds.

Figure 19:
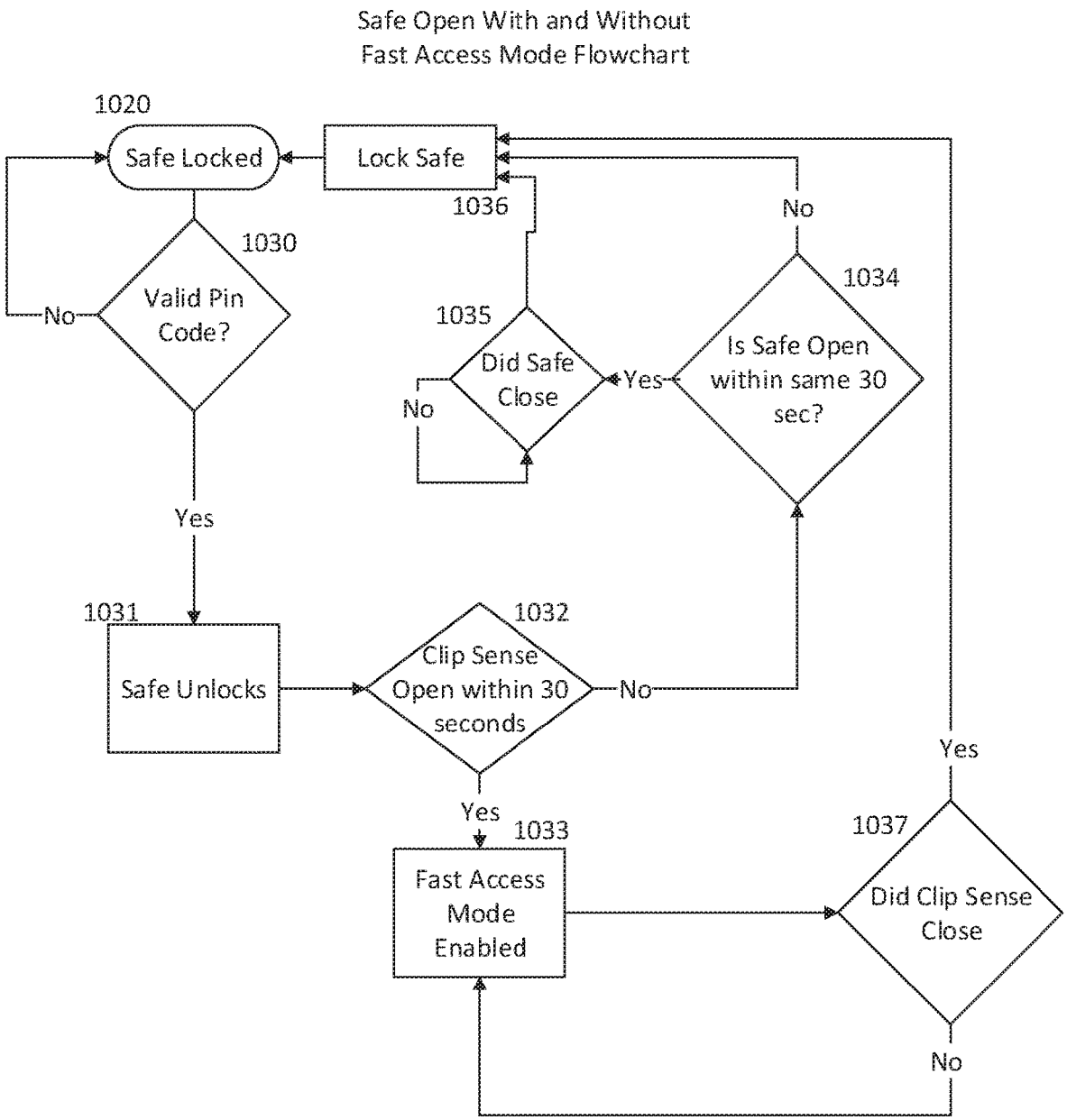
FIG. 19 depicts a flow diagram of one embodiment of an open function of an electronic embodiment of the portable safe of the invention.

Referring now to FIG. 19, a flow diagram of one embodiment of an "open" function of an electronic embodiment of the portable safe of the invention is depicted, in which the safe of the invention may be opened in either fast access mode, or non fast access mode. In this embodiment of the open function, the portable safe may begin in a locked condition 1020. The safe of the invention may be unlocked by a user entering a PIN code through pushbutton array 830 (depicted in FIG. 24) in step 1030. If controller 800 determines that the PIN code is correct 1030, controller 800 may command the electromechanical lock to an unlocked state, thus unlocking the safe 1031 so that it may be opened by operation of the latch thumb plate 251. If controller 800 determines that the PIN code is incorrect 1030, the safe remains locked 1020. After step 1031, controller 800 may continue to execute non transitory computer readable instructions to determine whether the clip sense circuit has opened within a predetermined programmable time, for example thirty seconds, step 1032. If the clip circuit has opened with a predetermined programmable time, for example thirty seconds, for example by placing the safe onto a pants belt by engaging clip 261 onto a belt, fast access mode is enabled 1033 in which the safe is unlocked and may be quickly opened by operating the latch into an open position. Controller 800 may continue to monitor the clip sense circuit 1037. If the clip sense circuit remains open 1037, fast access mode continues to remain enabled. If, however, clip sense circuit closes 1037, controller 800 commands the electromechanical lock of the invention into a locked state 1036, 1020, locking the safe, and the process can begin again by user entering a PIN code 1030.

Still referring to FIG. 19, if the clip sense circuit has not opened in a predetermined programmable time, for example thirty seconds, step 1032, controller 800 executes non transitory computer readable instructions to determine whether the safe has been opened with the predetermined programmable time, 1034. If it has, controller 800 executes non transitory computer readable instructions to determine whether the safe has been closed 1035. Once the safe has been closed 1035, controller 800 executes non transitory computer readable instructions to place the electromechanical lock in to a locked state 1036, 1020, locking the safe, and the process can begin again by user entering a PIN code 1030. If the safe is not opened within the predetermined programmable time, 1034, controller 800 executes non transitory computer readable instructions to place the electromechanical lock in to a locked state 1036, 1020, locking the safe, and the process can begin again by user entering a PIN code 1030.

Figure 20:
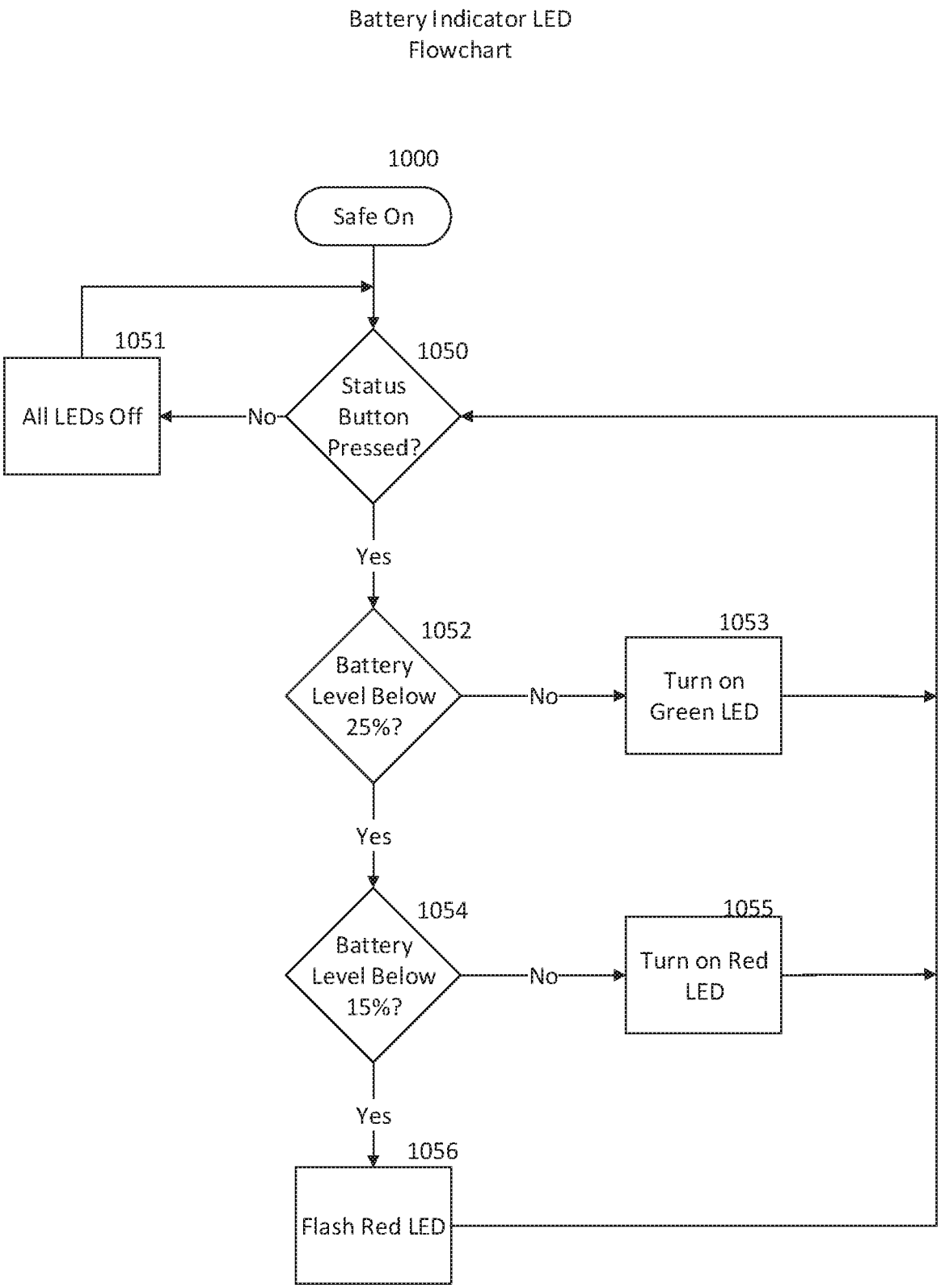
FIG. 20 depicts a flow diagram of one embodiment of a battery charge level indicator function of an electronic embodiment of the portable safe of the invention.

Referring now to FIG. 20, a flow diagram of one embodiment of a battery charge indicator function of an electronic embodiment of the portable safe of the invention is depicted. In an initial step 1000, the portable safe of the invention is powered on. Controller 800 may execute computer readable instructions to make a determination whether a status button, which may be, for example a button of pushbutton array 830, has been pressed by a user. If a status button has not been pressed, controller 800 will execute instructions to cause power status indicator light 812 to remain in an off, non-illuminated, state in step 1051 and controller 800 will continue to monitor the state of pushbutton array 830 in order to ascertain whether a status button has been pressed. If a status button has been pressed by the user 1050, controller 800 will execute instructions to receive a signal containing battery charge level information from battery charger and power conditioning circuitry 808 and to make a determination whether the battery charge level of battery 606 is below a predetermined medium-charge threshold, for example, 25% of full charge in step 1052. If, in step 1052, it is determined by controller 800 that the battery level is below a predetermined medium-charge threshold, controller 800 will then execute instructions to make a determination as to whether the battery level is below a predetermined low-charge threshold, step 1054. If the battery level is below a predetermined low-charge threshold, controller 800 may execute instructions to illuminate a red light, such as power status indicator light 812 operating in red mode, for example to flash, in step 1055, indicating that a low battery level condition exists. If, in step 1052, it is determined that the battery level is not below a predetermined medium-charge threshold, controller 800 will execute instructions to illuminate a green light, such as power status indicator light 812 operating in green mode, in step 1053. If, in step 1054 it is determined that the battery level is below a predetermined low-charge threshold, controller 800 may execute instructions turning on a red light. The lights referred to in this series of steps regarding battery indication are preferably visible on an exterior surface of the portable safe of the invention, or may transmit light through a transparent window allowing a user to view the indicated status without needing to open the portable safe or to unlock the portable safe. In an embodiment, controller 800 will only illuminate the lighting elements of the invention if a user has depressed one or more pushbuttons of pushbutton array 830, and such illumination may be for a predetermined length of time programmable by storing a time value in computer readable medium 810 which is read by controller 800 and used to determine the length of time for which it is desired that the lighting elements be illuminated, indicating status of the portable safe. In this manner the portable safe may be operated discretely because the lighting elements will only illuminate upon command by a user, and may only illuminate for a predetermined length of time.

Figure 21:
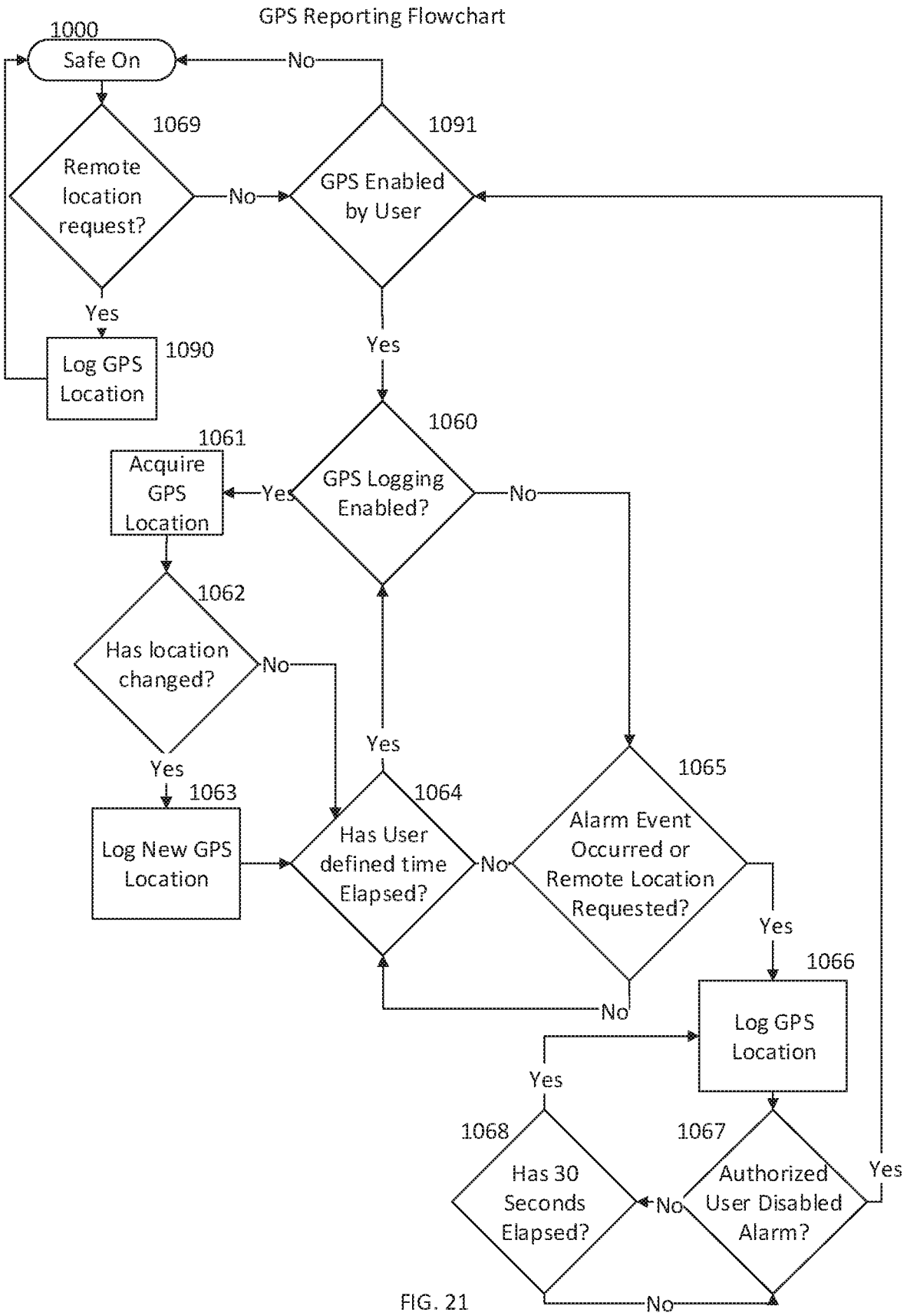
FIG. 21 depicts a flow diagram of one embodiment of a geolocation function of an electronic embodiment of the portable safe of the invention.

Referring now to FIG. 21, a flow diagram of one embodiment of a GPS geo-locating and location logging function of an electronic embodiment of the portable safe of the invention is depicted. In an initial step 1000 the portable safe of the invention is in an on condition. Controller 800 may execute instructions 1069 to determine whether a remote user has requested portable safe geolocation information 1069. If a remote user has requested geolocation information, controller 800 may execute instruction to read geolocation information from GPS receiver 802 and store the geolocation information in memory 1090 such as non transitory computer readable medium 810. If a remote user has not requested geolocation information 1069, controller 800 determines whether GPS has been enabled by a user 1091. If it has, controller 800 then may determine whether GPS logging has been enabled 1060. If GPS has not been enabled by a user 1091, controller 800 continues to monitor for a remote location request 1069.

If GPS has been enabled by a user 1091, and if GPS logging has been enabled by a user 1060, the GPS receiver 802 will acquire GPS location information 1061. If the location of the portable safe has changed 1062, for example beyond a predetermined limit, the new geolocation information is logged into non transitory computer readable media 1063. If a user defined time limit has elapsed 1064, controller 800 checks to see if GPS logging is enabled 1060 and the process repeats if it has. If GPS logging has not been enabled 1060, and if an alarm event has not occurred or if no remote location request has been received 1065, controller 800 checks to see if a user defined time limit has elapsed 1064.

Still referring to FIG. 21, if GPS logging has been enabled by a user 1060, GPS tracker transceiver 802 (depicted in FIG. 24) will acquire GPS satellite communication and will provide a signal corresponding to the geographic location of the portable safe, 1061. Controller 800 will store the location information from the signal corresponding to the geographic location of the portable safe in non-transitory computer readable non transitory computer readable medium 810 and may compare the geolocation information to previously stored geolocation information in step 1062 so as to make a determination as to whether the portable safe of the invention has been moved to a new location 1063. A user may, through the wireless interface or USB interface and by using an external device such as a laptop, tablet, cell phone, smart watch or any other device running portable safe application software, program geographic limitations or boundaries into the portable safe for storage in non transitory computer readable medium 810 so that the user may define custom geographic territorial limits which would result in a notification, which could be audible, visual, or message such as email, instant message, SMS text message or the like in those instances in which the portable safe has been moved beyond a predetermined geographic limits. If the geographic location of the portable safe has changed, for example beyond a predetermined geographic limit, step 1062, the new GPS geolocation information is received by controller 800 and stored in a non transitory computer readable medium 810. If the geolocation of the portable safe has not changed, for example beyond a predetermined geographic limit, step 1062, controller 800 executes instructions to determine whether 30 minutes has elapsed since the last geolocation reading, step 1064. If 30 minutes or more has elapsed, the cycle starts again and if GPS tracking remains enabled 1060, a new GPS geolocation signal is acquired step 1061. If 30 minutes has not elapsed since the last GPS geolocation reading, step 1064, the controller 800 executes instructions to determine whether any alarm event has occurred or whether a remote user has requested geolocation information, for instance, through the RF wireless transceiver or optical transceiver 806, step 1065. If no alarm event has occurred and if no remote location request has been made by a remote user, the system continues to monitor whether 30 minutes has elapsed since the last geolocation reading. If an alarm event has occurred or if a remote user has requested location information, step 1065, GPS location information of the portable safe is received by controller 800 and stored in non transitory computer readable medium 810. Next, controller 800 executes instructions to determine whether an authorized user has disabled the alarm, step 1067 if an authorized user has not disabled the alarm, controller 800 determines whether 30 seconds has elapsed 1068. If more than 30 seconds has elapsed the system logs GPS location data in step 1066 by causing controller 800 to execute instructions storing the GPS location data in non transitory computer readable medium 810. If 30 seconds has not elapsed, controller 800 continues to monitor whether an authorized user has disabled the alarm 1067. If, in step 1067, an authorized user has disabled the alarm, the system remains in the on state and controller 800 continues to monitor whether GPS tracking has been enabled and the method returns to step 1060.

Figure 22:
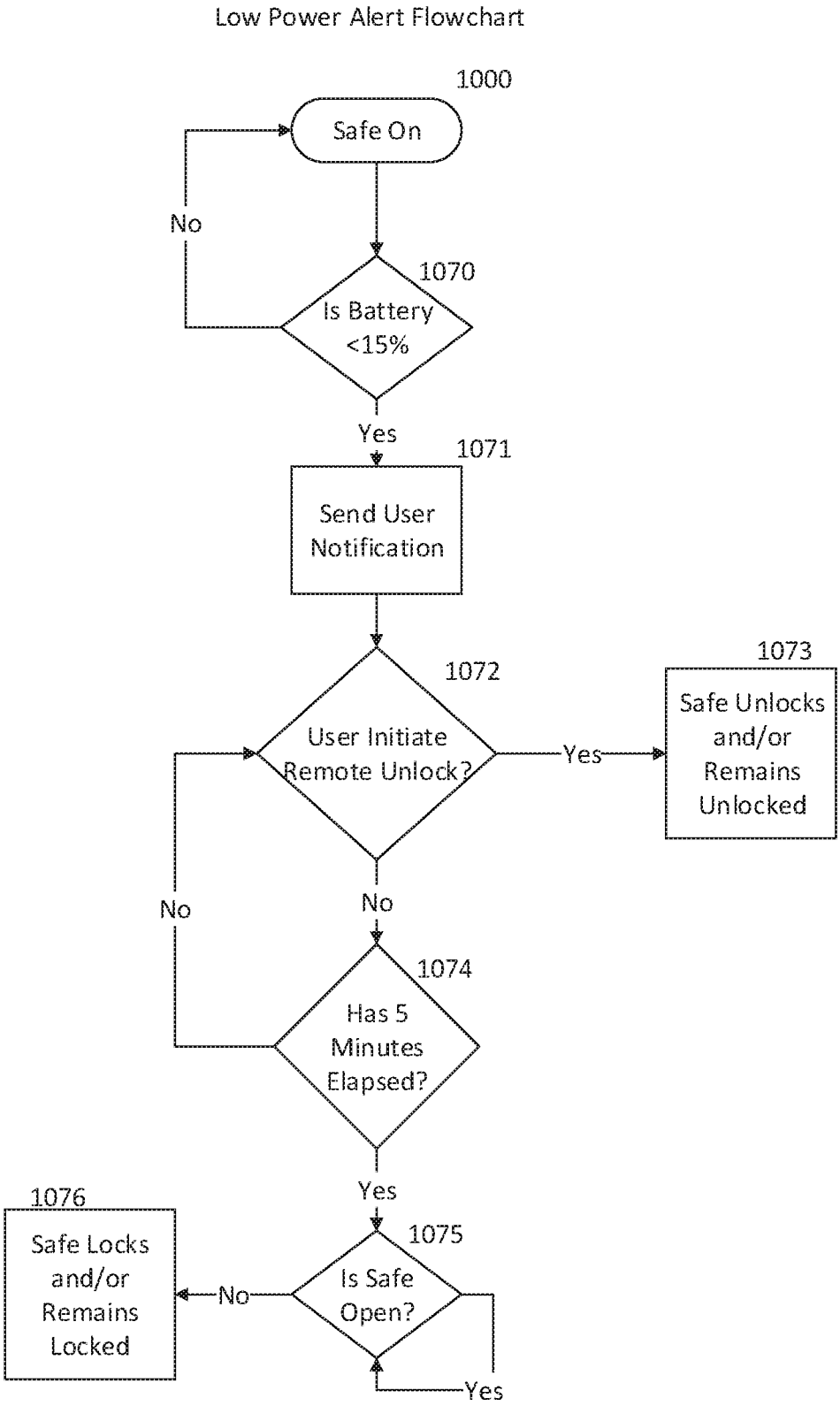
FIG. 22 depicts an electrical block diagram of a low battery charge level alert function of an electronic embodiment of the portable safe of the invention.

Referring now to FIG. 22, starting from a powered-on condition 1000, controller 800 will execute instructions to receive a signal from battery charger and power conditioning circuitry 808 and to make a determination whether the battery charge level of battery 606 is below a predetermined low-charge threshold, which may be for example 15% of full charge, in step 1070. If the battery charge level is below the predetermined low-charge threshold, a BATTERY CHARGE LOW or equivalent message will be transmitted to a remote user through wireless transceiver 806, step 1071. If a remote user has initiated a Remote Unlock command to the portable safe through wireless transceiver 806 or through USB interface 815 in step 1072, controller 800 will command the electromechanical lock into an unlocked state and the safe will remain unlocked 1073. If a remote user has not initiated a Remote Unlock command 1072, controller 800 will, for a programmable period of time, for example five minutes, continue to monitor for a Remote Unlock command 1072. If, after the programmable period of time, no Remote Unlock command has been received, controller 800 will command the electromechanical lock into an locked state if the safe is closed, causing the safe to be in a locked condition.

Figure 23:
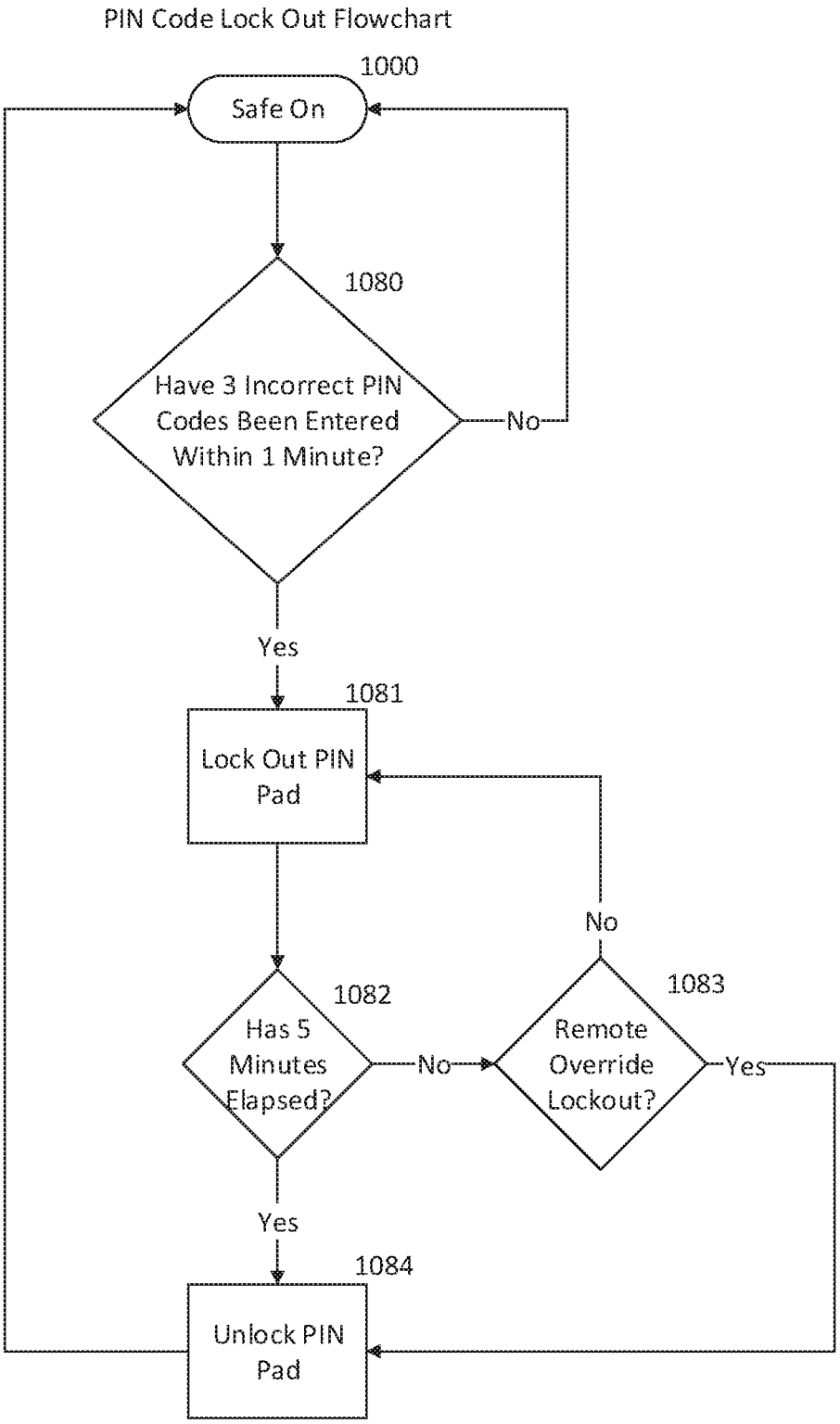
FIG. 23 depicts a flow diagram of one embodiment of a PIN code lockout function of an electronic embodiment of the portable safe of the invention.

Referring now to FIG. 23, a PIN code lockout flow diagram is presented. In an initial step the portable safe is power to an on state 1000. Once a user begins entering PIN codes into pushbutton array 830 or by any other means, controller 800 monitors to check if three incorrect PIN codes have been entered within a programmable period of time, for example one minute, step 1080. If they have, the PIN pad will be disabled 1081 and will not accept entry of PIN codes for a programmable PIN code lockout period 1082 which may be, for example, five minutes. A remote user may remotely, through wireless transceiver 806, transmit commands causing the lockout period to be terminated 1083 and unlocking, or re-enabling, PIN pad 1084 and returning the safe to a state in which a local user may again attempt to enter a PIN code through the PIN pad.

In any step of the invention described herein, the functions described as being carried out by controller 800 executing non transitory computer readable instructions may also be carried out by the various circuit elements that comprise electronics assembly 610 or any circuit elements connected thereto. Thus these functions are not limited to being carried out by controller 800, and the claims of the patent should be thus interpreted.

Figure 24:
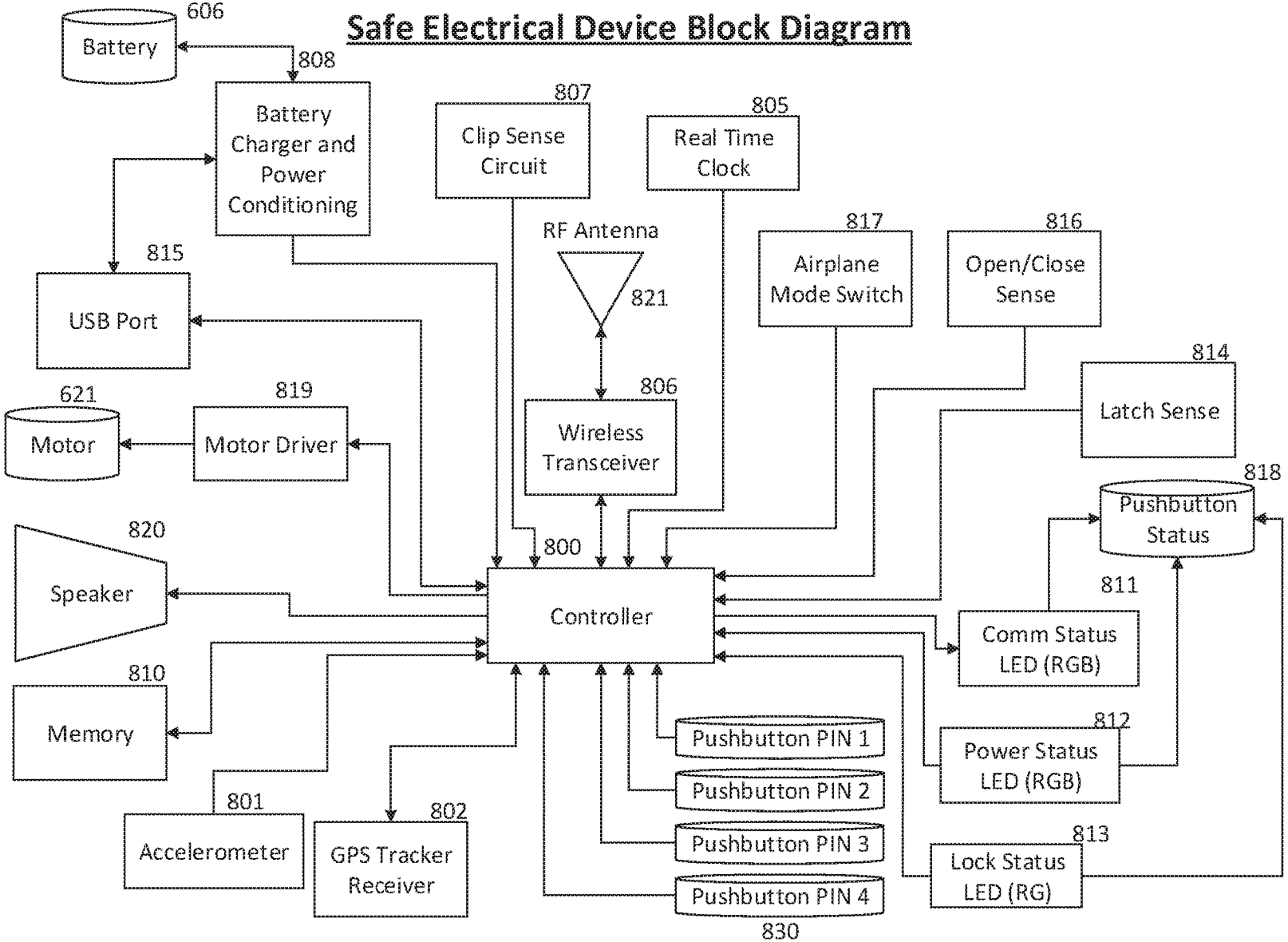
FIG. 24 depicts a block diagram of an electronic embodiment of the portable safe of the invention.

Referring now to FIG. 24, an electrical block diagram of an electronic embodiment of the portable safe of the invention is depicted. Controller 800 may be in electrical communication other electrical components of the portable safe of the invention is depicted in the diagram. Controller 800 may also be in electrical communication with non transitory computer readable medium 810. Non-transitory computer readable and executable instructions in the form of software, firmware, or other known forms of computer readable instructions capable of performing the functions described herein may be stored in a non-transitory fashion in non transitory computer readable medium 810. Controller 800 may access non transitory computer readable medium 810 for the purpose of retrieving computer readable instructions stored thereon and executing said computer readable instructions so as to carry out the functions described herein. Controller 800 may also be in electrical communication with sensor devices such as one or more accelerometers 801 and temperature reading devices (not shown in the drawings) and other sensors as may be known in the art. In this manner controller 800 may retrieve or otherwise receive information from one or more accelerometers 801 one or other sensors in the form of sensor signals, and may use the data from the sensor signals to perform the functions of the invention by executing computer readable instructions it has retrieved from non transitory computer readable medium 810.

Still referring to FIG. 24, controller 800 may also be in communication with one or more pushbuttons or other user interface elements 830 for receiving control inputs from a user. User interface elements may be, for example, buttons or switches located on any surface of the portable safe. Controller 800 may also be in electrical communication with a real-time clock or other internal timing device 805, and controller 800 may also be in electrical communication with interface devices such as radiofrequency or optical wireless transceiver 806 and near field communication transceiver 803. Near field communication transceiver 803 may also be in electrical communication with a near field communication antenna 804. Wireless transceiver 806 may also be wireless transceiver known in the art and may be in electrical communication with a radio frequency (RF) antenna or optical transceiver 821 as depicted in the diagram. Wireless transceiver 806 may be any radiofrequency or optical wireless transceiver known in the art for communicating data to and from a remote system such as, by way of example and not by way of limitation, any digital or analog radio communication transceiver, any optical communication transceiver such as infrared and other optical communication transceivers, radio frequency transceivers designed to operate on the standard known as Wi-Fi, Bluetooth, or any other known standard radiofrequency data communication physical layer and protocol, cellular-based RF communication transceiver such as GSM or other medication transceivers capable of communicating with a cellular-based RF communications network as is known in the art, and any other radiofrequency or optical transceiver known in the art. It is reasonably anticipated that emerging wireless communication systems may replace those listed in this description and it is within the disclosure and claim of invention that future developed wireless communication systems are included within the scope of the wireless transceiver, which may comprise a plurality of transceivers, of the portable safe of the invention. Controller 800 may also be in electrical communication with a data port 815 for programming non transitory computer readable medium 810, commanding controller 800, reading information from non transitory computer readable medium 810 or the like. Data port 815 may be any electrical data communication port, and may be serial or parallel, but is preferably a Universal Serial Bus (USB) data port.

The remote user data interface of a portable safe of the invention may comprise any one or any combination of radiofrequency or optical wireless transceiver 806, near field communication transceiver 803, and data port 815, in any number.

Controller 800 may also be in electrical communication with a geolocation receiver 802, which may be a Global Position System (GPS) receiver, capable of receiving geolocating signals from, for example, remote transmitters such as, but not limited to, GPS or other geo-positioning satellites, processing said geo-locating signals, and transmitting a signal comprising geolocation containing geolocation or time information, or both, for processing or retransmission by controller 800.

Still referring to FIG. 24, controller 800 may also be in electrical communication with a motor driver circuit 809 which is in electrical communication with a motor, such as a server motor or stepper motor, 621, for the purpose of receiving commands from controller 800 commanding motor 621 to dispose the electromechanical lock of the invention in a locked state or unlocked state. Motor 621 may be configured so as to engage or disengage an electromechanical lock mechanism as described elsewhere herein upon command from controller 800. Thus, as an example, if a remote user desires to lock or unlock the portable safe of the invention from a remote location, a command may be transmitted from the remote user by wireless means, for instance RF communication means such as GSM cellular transmission, which is received by the RF antenna portable safe of the invention. The wireless antenna is in electrical communication with wireless transceiver 806 which receives the signal transmitted from the remote user and received by the RF antenna, whereupon the received signal may be communicated to controller 800. Controller 800 may then interpret the signal sent by the remote user by the execution of computer readable instructions as read from non transitory computer readable medium 810, were upon controller 800 may command motor driver 809 to operate motor 621 to motivate the lock of the invention into a locked, or unlocked, position as commanded by the remote user. In this manner a remote user may command the portable safe of the invention into a locked state or an unlocked state.

Still referring to FIG. 24, controller 800 may be in direct or indirect communication with speaker 820. An audio amplifier may be in electrical communication with, and in line between, controller 800 and speaker 820 for the purpose of amplifying the audio signal or converting a digital signal to an analog audio signal for the purpose of driving speaker 820. In this manner, controller 800 may, upon execution of computer readable instructions stored in non transitory computer readable medium 810, cause certain sounds or audible signals to be emitted from speaker 820 as may be desired by the user and as described herein in the description of the functions of the electronic embodiment of the invention. In this manner alarm beeps or other audible signals may be utilized to indicate that the portable safe of the invention has been commanded into a locked state, an unlocked state, or any other state. Also in this manner, an audible alarm may be sounded if the accelerometer 801 senses that the portable safe of the invention has been moved, or if the optional geolocation receiver 802 receives GPS information indicating that the portable safe of the invention has been moved to a new geographic location outside limits set by the user. This use of GPS location information to trigger an alarm may be termed "geo-fencing". A user may predetermine certain geographic limitations such that an alarm is sounded or an alarm signal is transmitted to a remote user through the wireless transceiver interface if the portable safe of the invention has been moved outside, or moved into, predetermined geographic areas.

Still referring to FIG. 24, controller 800 may be directly or indirectly in electrical communication with several manual buttons making up pushbutton array 830 for the purpose of allowing a user to interface with the electronics of the portable safe in order to command the portable safe to perform certain functions, to enter certain states, or to enter personal identification information such as a Personal Identification Number (PIN) or other identifying indicia. For example, one or more buttons of pushbutton array 830 may be utilized to command the portable safe into a powered on or powered off condition; to request status of the portable safe, such as for example, status of the battery charge of the portable safe; or to provide and unlock commands to controller 800.

Still referring to FIG. 24, the portable safe of the invention may also comprise lighting elements of any color, or that may be commanded to illuminate in one of a variety of colors that may be red, green, blue, yellow, orange or other colors as desired by a user, that are in electrical communication with controller 800 such that controller 800 is capable of commanding the lighting elements to individually be in an on state, an off state, a blinking state, or any other state, so as to provide visual indication of the status of the invention to a user. For example, controller 800 may be in electrical communication with lighting elements such as communication status lighting element 811, power status lighting element 812, or lock status lighting element 813 or any combination thereof. The lighting elements of the portable safe are preferably, but not necessarily, light emitting diodes (LEDs), and may each have the capability to illuminate one color selected from a number of colors such as red, green, blue, yellow, orange, white or other colors, as commanded by controller 800 executing non-transitory computer readable instructions, and wherein specific lighting elements may be commanded to illuminate specific colors in certain situations, as commended by controller 800.

Still referring to FIG. 24, controller 800 may also be in electrical communication with at least one sensor for sensing the status of portable safe. In an embodiment, the at least one sensor may comprise a plurality of sensors, such as, for example, latch state sensor 814 which produces a signal containing information indicating whether the latch of the invention is in an unlatched state or latched state, safe open/close sensor 816 which produces a signal containing information indicating whether the first portion and second portion of the invention are disposed in an open position or a closed position, and clip sense circuit 807, all of which may be in electrical communication with controller 800. The status of the buttons making up pushbutton array 830 may be stored in registers 818, which may be a part of non transitory computer readable medium 810.

Still referring to FIG. 24, battery 606 may be charged through an electrical port providing electrical connectivity to a battery charging source, the port being located on, in or through an exterior surface of the invention, and which may be USB port 815. Battery 606 may be in electrical communication with battery charger and power conditioning circuit 808, and may provide power to all the electrical and electronic components of the portable safe directly, or through battery charger and power conditioning circuit 808.

Still referring to FIG. 24, controller 800 may be any electrical device or combination of electrical devices capable of executing computer readable instructions such a controller, microcontroller, microprocessor, programmable logic array, embedded firmware, virtual machine, combinational logic or any other electrical or electronic device or combination of devices known in the electrical arts as capable of executing computer readable instructions.

The portable safe of the invention may comprise a fast access mode so that a user may have immediate access to the contents of the safe. In fast access mode, the portable safe is unlocked and latched, allowing a user to manually open the portable safe as needed immediately. Fast access mode may be enabled by a user presenting authenticating indicia to the portable safe, then, within ten (10) seconds, the user must manually slide a slider switch to an active position. The slider switch may be located on an exterior surface of the portable safe and may be in electrical communication with controller 800. For safety considerations, a user must perform another positive identification to the portable safe in order to prevent accidental and unauthorized opening of the safe.

Figure 25:
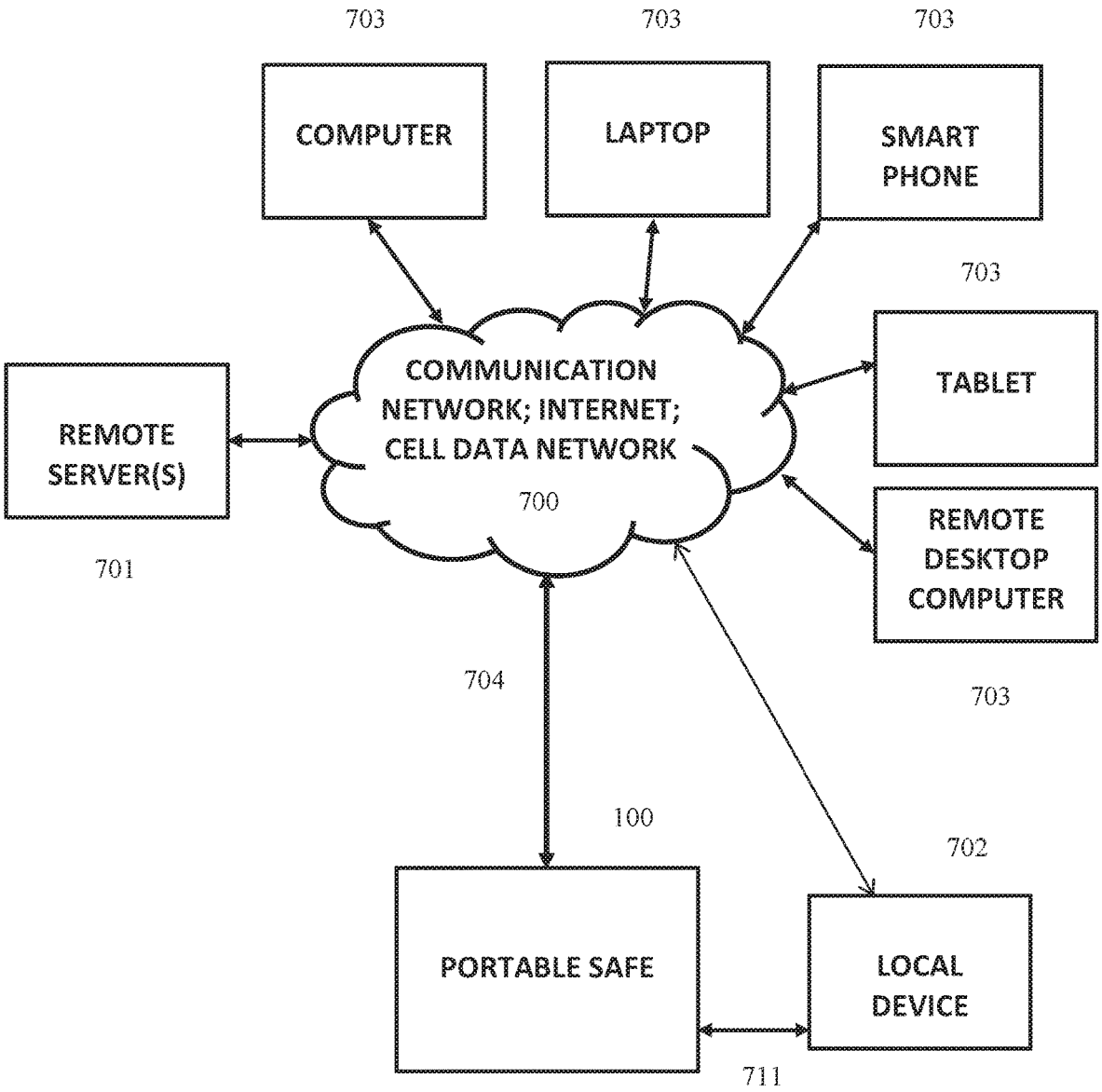
FIG. 25 depicts a system diagram of the portable safe of the invention in wireless connectivity to a remote server, a remote user device such as a computer, laptop, cell phone, smartphone, tablet, remote desktop, or any other remote smart or computing device running portable safe application software; and also showing the portable safe of the invention and wireless or wired communication with a local device which may be a computer, laptop, cell phone, smartphone, tablet or any other smarter computing device running portable safe application software.

Referring now to FIG. 25, the portable safe of the invention 100 may be in wireless or wired communication 704 with local and/or remote computing devices 702 and 703, respectively, as described herein. The portable safe 100 may be in communication with one or more local devices 702, which may be any electronic device, such as a smart phone, tablet, computer, or other device capable of running portable safe application software and storing user authentication indicia. The portable safe may be in communication with the local device wirelessly through any known wireless communication link, including but not limited to Wi-Fi, Bluetooth, or any RF communication link, or infrared optical communication links. The portable safe may also be in wired communication with one or more local devices 702 via a USB port or any other electrical connection. The local device 702 may store and execute portable safe application software to communicate with the portable safe 100 and to command the portable safe to carry out the functions depicted in the flowcharts and described elsewhere herein. Likewise, portable safe 100 may also be in communication with one or more remote devices 703 which may be any number or combination of computers, smart phones, tablet computers, laptop computers, desktop computers, smart phones or any other device capable of running and executing portable safe application software and storing user authentication indicia. Communication between the portable safe 100 and the remote devices 703 may be wired or wireless through the remote user data interface. In the case of wireless communication the remote devices and portable safe may communicate via GSM, CDMA or other cellular radio based communication links, RF analog radio data links, the Internet, IEEE 802.11 wireless LAN, other wireless LANS or any other communication network, and in any combination thereof. In this manner the portable safe of the invention 100 may be controlled, monitored or tracked geographically remotely as described herein, and remote users may command the portable safe into locked or unlocked modes, may receive alerts and alarm information as described herein and may receive other status information as desired by the remote user. The portable safe may also be in wireless communication with a remote server 701 via the world wide web 700 as shown in the figure. In a preferred embodiment all portable safe configuration information, status inquiries, and notifications may be communicated via the world wide web to a remote server 700, where it may be made available to a local user or a remote user via, for example, a web site or application running on a remote device such as a cell phone software application.

The invention may comprise portable safe application software, which may include non-volatile computer readable instructions, and which may be downloaded to a local device 702 or a remote computing device 703 from a remote server 701 through, for example the world wide web 700, from online application stores, or from or through any other source, and may reside in a local electronic device non transitory computer readable medium. The portable safe application software is operable to provide a user interface for the entering and the transmitting of commands to a portable safe of the invention 100 remote user data interface and may contain instructions allowing a user to establish, store and execute schedules for events such as scheduling locking and unlocking of the portable safe, GPS tracking and geolocation information storage, monitoring batter status, and the like. The portable safe application software may contain instructions for carrying out the methods and steps described and taught herein.

It can be seen that the portable safe of the invention may easily be worn on the external clothing of a user, may be opened quickly allowing quick access to a firearm or other valuable item stored inside in an enclosed volume, may be locked locally or remotely to prevent unauthorized entry. The portable safe of the invention prevents a user from using the portable safe to carry a firearm that has a round loaded into the chamber for safety purposes, and has the appearance of a commonly carried item, such as a ruggedized cell phone case, for purposes of diversion and concealment.

INDUSTRIAL APPLICABILITY

The present invention overcomes the shortcomings of the prior art in that it may be used to conceal a valuable item, such as, for example, money, jewelry, important documents, medications or other valuables, or, in an embodiment, a firearm, such that such items may be carried by a user without displaying the item or the item's outline. The invention also allows quick drawing of a firearm so that it is readily available for use in emergency situations. The invention may also be locally lockable by a user using, for example, a pushbutton array, or may be remotely lockable by a user by means of communication over the remote user data interface; may comprise optional GPS tracking for geolocation of the portable safe and its contents; and may comprise one or more means for communication with a remote user or system, such as radiofrequency wireless and optical communications transceivers and the like. In this manner, a user may lock a portable safe manually or from a remote location so that it is not able to opened by an unauthorized user. Likewise, a remote user may be able to track the geographic location of the safe and its contents by utilizing geolocation information or triangulation, such as GPS or cell-based geolocation information, that is reported from the safe, of geolocation information regarding the geographic location of the portable safe may be reported from cell towers and data network systems to which the portable safe is wirelessly connected through radiofrequency or other wireless communications means such as, for instance and not by way of limitation, GSM, analog data network, Wi-Fi, Bluetooth, or any other radiofrequency or optical communication systems known in the art. The portable safe may also report its condition and/or status, such as "open", "locked" or "unlocked" to a user such as a remote user communicating with the portable safe via the world wide web. The invention provides a novel, secure device and method for safely carrying items of value, while still allowing quick access to those items if needed.

What is claimed is:

1. A wearable portable safe, comprising:

a back plate having at least one interior surface and at least one exterior surface;

a cover having at least one interior surface and at least one exterior surface;

and a barrel pin having a tip, a length and an outer diameter, said barrel pin outer diameter forming a sliding engagement between said barrel pin and a firearm when a firearm barrel is motivated onto said barrel pin;

wherein said back plate and said cover form a hinged attachment between them allowing said cover to rotate toward said cover about said hinged attachment into a closed position thereby forming an interior volume that is enclosed by said at least one interior surface of said back plate and said at least one interior surface of said cover, and said hinged attachment allowing said cover to rotate away from said back plate about said hinged attachment into an open position thereby exposing said at least one interior surface of said back plate and said at least one interior surface of said cover;

wherein said barrel pin is attached to an interior surface of back plate, and said barrel pin is disposed such that a firearm slidingly engaged onto said barrel pin is enclosed within said interior volume when said said cover is rotated towards said back plate into said closed position; and said barrel pin is disposed such that a firearm slidingly engaged onto said barrel pin is able to be extracted from said barrel pin when said cover is rotated away from said back plate into said open position; and wherein said cover rotates away from a side of a firearm disposed on said barrel pin when rotating about said hinged attachment into said open position.

2. The portable safe of claim 1, further comprising:

a latch disposed on said back plate or said cover, said latch having a latched position, an unlatched position;

wherein said latch prevents said cover from rotating away from said back plate into an open position when said back plate and said cover are disposed in said closed position and said latch is disposed in said latched position;

wherein said latch allows said back plate and said cover to rotate into an open position when said latch is disposed in said unlatched position; and a lock having a locked state and an unlocked state, wherein said lock prevents said latch from being disposed in an unlatched position when said lock is disposed in said locked state, and wherein said lock allows said latch to be disposed in an unlatched position when said lock is disposed in an unlocked state.

3. The portable safe of claim 2:

wherein said lock is further defined as an electromechanical lock in communication with a controller, wherein said electromechanical lock is capable of being commanded into said locked state or said unlocked state by receiving commands from said controller;

wherein said controller is in communication with a wireless transceiver;

and wherein said portable safe further comprises:

at least one remote user data interface in communication with said controller;

at least one lighting element disposed visible on or through an exterior surface of either of said back plate or said cover;

at least one electrical switch in communication with said controller for user input to said controller, said electrical switch accessible on or through said exterior surface of either of said back plate or said cover so that it is able to be manipulated by a user;

a battery in communication with said controller and said remote user data interface; and a non-transitory computer readable medium in communication with said controller, said computer readable medium comprising non-transitory computer-executable instructions for performing steps comprising:

receiving and storing an authorized personal identification code from either said electrical switch or from a remote user through said remote user data interface;

storing said authorized personal identification code in said non-transitory computer readable medium;

receiving command signals from a remote user through said remote user data interface;

commanding an electromechanical lock into a locked state or an unlocked state;

transmitting status information to a remote user through said wireless transceiver;

receiving a signal from said at least one electrical switch; and commanding said at least one lighting element to illuminate to indicate a status of said portable safe.

4. The portable safe of claim 3, further comprising a geolocation receiver, said geolocation receiver capable of receiving geo-locating signals, processing said geo-locating signals, and transmitting a signal comprising geolocation information, said geolocation signal comprising geolocation information identifying a geographic location of the portable safe.

5. The portable safe of claim 4, wherein said geolocation receiver is in communication with said controller, and wherein said non-transitory computer-executable instructions further comprises instructions for the steps of receiving said geolocation signal from said geolocation receiver and transmitting said geolocation signal to a remote user via said at least one remote user data interface.

6. The portable safe of claim 3, wherein said non-transitory computer readable medium comprising computer-executable instructions further comprises instructions for the steps of creating a log of portable safe events, and transmitting said log to a remote user via said remote user data interface.

7. The portable safe of claim 6, wherein said portable safe events comprise a timestamp for each of one or more of the group consisting of lock events, unlock events, portable safe open events, and portable safe close events.

8. The portable safe of claim 3, wherein said non-transitory computer readable medium comprising computer-executable instructions further comprises instructions for the steps of:

receiving a scheduled unlock signal from a remote user through said remote user data interface, said scheduled unlock signal containing information establishing an unlock time for commanding said electromechanical lock into an unlocked state;

storing said unlock time; and commanding said electromechanical lock into an unlocked state at said unlock time.

9. The portable safe of claim 3, wherein said non-transitory computer readable medium comprising computer-executable instructions further comprises instructions for the steps of;

receiving a scheduled lock signal from a remote user through said remote user data interface, said scheduled lock signal containing information establishing an lock time for commanding said electromechanical lock into a locked state;

storing said lock time; and commanding said electromechanical lock into a locked state at said lock time.

10. The portable safe of claim 3, wherein said non-transitory computer readable medium comprising computer-executable instructions further comprises instructions for the steps of receiving a personal identification code from said at least one electrical switch when said switch is operated by a user, and unlocking the electromechanical lock when an authorized personal identification code has been entered by a user through said electrical switch.

11. The portable safe of claim 3, further comprising an open/close sense circuit, said open/close sense circuit in communication with said controller and operable to provide an open/close signal to said controller communicating to the controller whether said back plate and said cover are disposed in an open position or a closed position.

12. The portable safe of claim 11, further comprising a speaker in communication with said controller, and wherein said non-transitory computer readable medium comprising computer-executable instructions further comprises instructions for the steps of receiving said open/close sense signal to detect whether said back plate and said cover are disposed in an open position or a closed position; and causing an audible alarm to be transmitted through said speaker in the case in which an authorized personal identification code has not been received by said controller prior to said back plate and said cover being disposed in an open position.

13. The portable safe of claim 11, wherein said non-transitory computer readable medium comprising computer-executable instructions further comprises instructions for the steps of:

receiving said open/close sense signal to detect whether said back plate and said cover are disposed in an open position or a closed position; and causing an alarm message to be transmitted through said remote user data interface to a remote user in the case in which an authorized personal identification code has not been received by said controller prior to said back plate and said cover being disposed in an open position.

14. The portable safe of claim 11, wherein said non-transitory computer readable medium comprising computer-executable instructions further comprises instructions for the steps of;

receiving said open/close sense signal to detect whether said back plate and said cover are disposed in an open position or a closed position; and causing said lighting element to illuminate in the case in which an authorized personal identification code has not been received by said controller prior to said back plate and said cover being disposed in an open position.

15. The portable safe of claim 3, further comprising at least one accelerometer disposed on a surface, said at least one accelerometer in communication with said controller and operable to provide a movement signal to said controller communicating to the controller a degree to which movement has occurred.

16. The portable safe of claim 15, further comprising a speaker in communication with said controller, and wherein said computer readable medium comprising computer-executable instructions further comprises instructions for the steps of:

receiving a predetermined threshold for movement from a remote user through said remote user data interface;

storing said predetermined threshold for movement;

receiving said movement signal from said at least one accelerometer;

comparing a degree to which movement has occurred to said predetermined threshold for movement; and causing an audible alarm to be transmitted through said speaker in the case in which an authorized personal identification code has not been received by said controller and said degree to which movement has occurred exceeds said movement threshold.

17. The portable safe of claim 15, wherein said non-transitory computer readable medium comprising computer-executable instructions further comprises instructions for the steps of:

receiving a predetermined threshold for movement from a remote user through said remote user data interface;

storing said predetermined threshold for movement;

receiving said movement signal from said at least one accelerometer;

comparing a degree to which movement has occurred to said predetermined threshold for movement; and causing an alarm message to be transmitted to a remote user through said at least one remote user data interface in the case in which an authorized personal identification code has not been received by said controller and said degree to which movement has occurred exceeds said movement threshold.

18. The portable safe of claim 15, wherein said non-transitory computer readable medium comprising computer-executable instructions further comprises instructions for the steps of:

receiving a predetermined threshold for movement from a remote user through said remote user data interface;

storing said predetermined threshold for movement;

receiving said movement signal from said at least one accelerometer;

comparing a degree to which movement has occurred to said predetermined threshold for movement; and causing said lighting element to be illuminated in the case in which an authorized personal identification code has not been received by said controller and said degree to which movement has occurred exceeds said movement threshold.

19. The portable safe of claim 3, wherein said non-transitory computer readable medium comprising computer-executable instructions further comprises instructions for the step of commanding said electromechanical lock into an unlocked state when an authorized personal identification code has been received by said controller.

20. The portable safe of claim 3, wherein said attaching structure is further defined as a clip, and further comprising a clip sense circuit, said clip sense circuit in communication with said controller and providing a clip sense signal to said controller communicating to the controller whether said clip has been removably attached to an exterior structure.

21. The portable safe of claim 20, wherein said non-transitory computer readable medium comprising computer-executable instructions further comprises instructions for the step of commanding said electromechanical lock into an unlocked state in the case in which an authorized personal identification code has been received by said controller and said clip sense circuit signal indicates to said controller that said clip has been removably attached to an exterior structure within a first predetermined time from reception of an authorized personal identification code by said controller.

22. The portable safe of claim 21 in which said first predetermined time is thirty seconds.

23. The portable safe of claim 22, wherein said non-transitory computer readable medium comprising computer-executable instructions further comprises instructions for the step of causing an alarm message to be transmitted through said at least one remote user data interface to a remote user in the case in which an authorized personal identification code is not received by said controller within a second predetermined time from the time said clip sense circuit signal indicates to said controller that said clip has been removed from an exterior structure.

24. The portable safe of claim 21, wherein said non-transitory computer readable medium comprising computer-executable instructions further comprises instructions for the step of commanding said electromechanical lock into a locked state when said clip sense signal indicates to said controller that said clip has been removed from an exterior structure.

25. The portable safe of claim 21, further comprising a speaker in communication with said controller, and wherein said non-transitory computer readable medium comprising computer-executable instructions further comprises the step of causing an audible alarm to be transmitted through said speaker in the case in which an authorized personal identification code is not received by said controller within a second predetermined time from the time said clip sense circuit signal indicates to said controller that said clip has been removed from an exterior structure.

26. The portable safe of claim 21, wherein said non-transitory computer readable medium comprising computer-executable instructions further comprises instructions for the step of causing said lighting element to illuminate in the case in which an authorized personal identification code is not received by said controller within a second predetermined time from the time said clip sense circuit signal indicates to said controller that said clip has been removed from an exterior structure.

27. The portable safe of claim 3, wherein said at least one remote user data interface is further defined as comprising at least one radio frequency transceiver.

28. The portable safe of claim 27, wherein said non-transitory computer readable medium comprising computer-executable instructions further comprises instructions for the step of commanding said lighting element to illuminate when said at least one radio frequency transceiver has established a communication link with a remote radio frequency transceiver.

29. The portable safe of claim 27, wherein said at least one radio frequency transceiver comprises a wireless LAN transceiver and a cellular data network transceiver.

30. The portable safe of claim 29, wherein said non-transitory computer readable medium comprising computer-executable instructions further comprises instructions for the step of selecting said wireless LAN transceiver as a primary wireless communication means for communicating with a remote user, and using said cellular data network transceiver for communication with a remote user only when said wireless LAN transceiver has not established a communication link with a remote radio frequency transceiver.

31. The portable safe of claim 3, wherein said at least one remote user data interface is further defined as comprising a wired electrical interface.

32. The portable safe of claim 31, wherein said wired electrical interface is a serial data interface.

33. The portable safe of claim 3, wherein said at least one remote user data interface is further defined as comprising an optical transceiver.

34. The portable safe of claim 3, further comprising battery charger and power conditioning circuit in communication with said controller and said battery and producing a signal containing battery charge level information; and wherein said non-transitory computer readable medium comprising computer-executable instructions further comprises instructions for the steps of receiving said signal containing battery charge level information, and causing said lighting element to periodically illuminate with a first color in the case in which said battery charge level is below a predetermined low-charge threshold.

35. The portable safe of claim 34, wherein said non-transitory computer readable medium comprising computer-executable instructions further comprises instructions for the step of causing said lighting element to illuminate with said first color in the case in which said battery charge level is below a predetermined medium-charge threshold but is not below a predetermined low-charge threshold.

36. The portable safe of claim 35, wherein said non-transitory computer readable medium comprising computer-executable instructions further comprises instructions for the step of causing said lighting element to illuminate with a second color in the case in which said battery charge level is not below said predetermined medium-charge threshold.

37. The portable safe of claim 3, further comprising:

a battery charger and power conditioning circuit in communication with said controller and said battery, said battery charger and power conditioning circuit producing a signal containing battery charge level information; and an open/close circuit producing a signal indicating whether said back plate and cover are disposed in an open position or a closed position;

wherein said non-transitory computer readable medium comprising computer-executable instructions further comprises instructions for the step of a. receiving said signal containing battery charge level information;

b. receiving said open/close signal to determine whether said back plate and said cover are in a closed position or an open position;

c. transmitting a message to a remote user through said remote user data interface in the event said battery charge level information indicates that said battery charge is below a predetermined low-charge threshold;

d. waiting for a predetermined time period to receive a remote unlock command from a remote user;

e. commanding said electromechanical lock to an unlocked state if a remote unlock command is received from a remote user within said predetermined time period; and f. commanding said electromechanical lock to a locked state if no remote unlock command is received from a remote user within said predetermined time period and if the back plate and said cover are in a closed position.

38. The portable safe of claim 1, wherein said length of said barrel pin is long enough that said tip of said barrel pin contacts an ammunition round loaded into a chamber of a firearm when a user attempts to slidingly engage said firearm onto said barrel pin, said contact preventing a firearm with an ammunition round loaded into a chamber from being fully slidingly engaged onto said barrel pin such that said back plate and said cover are unable to be rotated together into said closed position when a barrel of a firearm having a round in a chamber is inserted onto said barrel pin in said sliding engagement.

39. The portable safe of claim 1, further comprising a belt clip disposed on an exterior surface of either of said first portion or said second portion, said clip capable of removable attachment to a belt of a user.

40. The portable safe of claim 39, wherein said length of said barrel pin is long enough that said tip of said barrel pin contacts an ammunition round loaded into a chamber of a firearm when a user attempts to sliding engage said firearm onto said barrel pin, said contact preventing a firearm with an ammunition round loaded into a chamber from being fully slidingly engaged onto said barrel pin such that said back plate and said cover are unable to be rotated together into said closed position when a barrel of a firearm having a round in a chamber is inserted onto said barrel pin in said sliding engagement.

41. A wearable portable safe, comprising:

a back plate having at least one interior surface, and at least one exterior surface;

a cover having at least one interior surface, and at least one exterior surface;

wherein said back plate and said cover form a hinged attachment between them allowing said cover to rotate toward said back plate about said hinged attachment into a closed position thereby forming an interior volume that is enclosed by said at least one interior surface of said back plate and said at least one interior surface of said cover, and said hinged attachment allowing said cover to rotate away from said back plate about said hinged attachment into an open position thereby exposing said at least one interior surface of said back plate and said at least one interior surface of said cover;

a latch disposed on a second edge of either of said back plate or said cover, said latch having a latched position, an unlatched position, and a thumb plate for selecting between said latched position and said unlatched position;

wherein said latch prevents said back plate and said cover from rotating away from one another into an open position when said back plate and said cover are disposed in said closed position and said latch is disposed in said latched position;

wherein said latch allows said back plate and said cover to rotate into an open position when said latch is disposed in said unlatched position; and an electromechanical lock having a locked state and an unlocked state, wherein said electromechanical lock prevents said latch from being disposed in an unlatched position when said lock is disposed in said locked state, and wherein said lock allows said latch to be disposed in an unlatched position when said lock is disposed in an unlocked state, and wherein said electromechanical lock is in communication with said controller and is capable of being commanded into said locked state or said unlocked state by receiving commands from said controller;

a controller in communication with a wireless transceiver;

a clip disposed on an exterior surface of either of said back plate or said cover, said clip capable of attachment to exterior receiving structure;

at least one remote user data interface in communication with said controller;

at least one lighting element disposed visible on or through an exterior surface of either of said back plate or said cover;

at least one electrical switch in communication with said controller for user input to said controller, said electrical switch accessible on or through said exterior surface of either of said back plate or said cover so that it is able to be manipulated by a user;

a battery in communication with said controller and said remote user data interface; and a non-transitory computer readable medium in communication with said controller, said computer readable medium comprising non-transitory computer-executable instructions for performing steps comprising:

receiving and storing an authorized personal identification code from either said electrical switch or from a remote user through said wireless interface;

storing said authorized personal identification code in said non-transitory computer readable medium;

receiving command signals from a remote user through said wireless transceiver;

commanding said electromechanical lock into a locked state or an unlocked state;

transmitting status information to a remote user through said wireless transceiver;

receiving a signal from said at least one electrical switch; and commanding said at least one lighting element to illuminate for indicating a status of a portable safe;

wherein said cover rotates away from a side of a firearm disposed in said interior volume when rotating about said hinged attachment into said open position.

42. The portable safe of claim 41, further comprising a geolocation receiver, said geolocation receiver capable of receiving geolocating signals, processing said geolocating signals, and transmitting a signal comprising geolocation information, said geolocation signal comprising geolocation information identifying a geographic location of the portable safe.

43. The portable safe of claim 42, wherein said geolocation receiver is in communication with said controller, and said non-transitory computer-executable instructions further comprise instructions for the steps for receiving said geolocation signal from said geolocation receiver and transmitting said geolocation signal to a remote user via said at least one remote user data interface.

44. The portable safe of claim 41, wherein said non-transitory computer readable medium comprising computer-executable instructions further comprises instructions for the steps of creating a log of portable safe events, and transmitting said log to a remote user via said remote user data interface.

45. The portable safe of claim 44, wherein said portable safe events comprise a timestamp for each of one or more of the group consisting of lock events, unlock events, portable safe open events, and portable safe close events.

46. The portable safe of claim 41, wherein said non-transitory computer readable medium comprising computer-executable instructions further comprises instructions for the steps of:

receiving a scheduled unlock signal from a remote user through said remote user data interface, said scheduled unlock signal containing information establishing an unlock time for commanding said electromechanical lock into an unlocked state;

storing said unlock time; and commanding said electromechanical lock into an unlocked state at said unlock time.

47. The portable safe of claim 41, wherein said non-transitory computer readable medium comprising computer-executable instructions further comprises instructions for the steps of;

receiving a scheduled lock signal from a remote user through said remote user data interface, said scheduled lock signal containing information establishing an lock time for commanding said electromechanical lock into a locked state;

storing said lock time; and commanding said electromechanical lock into a locked state at said lock time.

48. The portable safe of claim 41, wherein said non-transitory computer readable medium comprising computer-executable instructions further comprises steps of receiving a personal identification code from said at least one electrical switch when said switch is operated by a user, and unlocking the electromechanical lock when an authorized personal identification code has been entered by a user through said electrical switch.

49. The portable safe of claim 41, further comprising an open/close sense circuit, said open/close sense circuit in communication with said controller and operable to provide an open/close signal to said controller communicating to the controller whether said back plate and said cover are disposed in an open position or a closed position.

50. The portable safe of claim 49, further comprising a speaker in communication with said controller, and wherein said non-transitory computer readable medium comprising computer-executable instructions further comprises instructions for the steps of:

receiving said open/close sense signal to detect whether said back plate and said cover are disposed in an open position or a closed position; and causing an audible alarm to be transmitted through said speaker in the case in which an authorized personal identification code has not been received by said controller prior to said back plate and said cover being disposed in an open position.

51. The portable safe of claim 49, wherein said non-transitory computer readable medium comprising computer-executable instructions further comprises instructions for the steps of:

receiving said open/close sense signal to detect whether said back plate and said cover are disposed in an open position or a closed position; and causing an alarm message to be transmitted through said remote user data interface to a remote user in the case in which an authorized personal identification code has not been received by said controller prior to said back plate and said cover being disposed in an open position.

52. The portable safe of claim 49, wherein said non-transitory computer readable medium comprising computer-executable instructions further comprises instructions for the steps of;

receiving said open/close sense signal to detect whether said back plate and said cover are disposed in an open position or a closed position; and causing said lighting element to illuminate in the case in which an authorized personal identification code has not been received by said controller prior to said back plate and said cover being disposed in an open position.

53. The portable safe of claim 41, further comprising at least one accelerometer disposed on a surface, said at least one accelerometer in communication with said controller and operable to provide a movement signal to said controller communicating to the controller a degree to which movement has occurred.

54. The portable safe of claim 53, further comprising a speaker in communication with said controller, and wherein said computer readable medium comprising computer-executable instructions further comprises instructions for the steps of:

receiving a predetermined threshold for movement from a remote user through said remote user data interface;

storing said predetermined threshold for movement;

receiving said movement signal from said at least one accelerometer;

comparing a degree to which movement has occurred to said predetermined threshold for movement; and causing an audible alarm to be transmitted through said speaker in the case in which an authorized personal identification code has not been received by said controller and said degree to which movement has occurred exceeds said movement threshold.

55. The portable safe of claim 53, wherein said non-transitory computer readable medium comprising computer-executable instructions further comprises instructions for the steps of:

receiving a predetermined threshold for movement from a remote user through said remote user data interface;

storing said predetermined threshold for movement;

receiving said movement signal from said at least one accelerometer;

comparing a degree to which movement has occurred to said predetermined threshold for movement; and causing an alarm message to be transmitted to a remote user through said at least one remote user data interface in the case in which an authorized personal identification code has not been received by said controller and said degree to which movement has occurred exceeds said movement threshold.

56. The portable safe of claim 53, wherein said non-transitory computer readable medium comprising computer-executable instructions further comprises instructions for the steps of:

receiving a predetermined threshold for movement from a remote user through said remote user data interface;

storing said predetermined threshold for movement;

receiving said movement signal from said at least one accelerometer;

comparing a degree to which movement has occurred to said predetermined threshold for movement; and causing said lighting element to be illuminated in the case in which an authorized personal identification code has not been received by said controller and said degree to which movement has occurred exceeds said movement threshold.

57. The portable safe of claim 41, wherein said non-transitory computer readable medium comprising computer-executable instructions further comprises instructions for the step of commanding said electromechanical lock into an unlocked state when an authorized personal identification code has been received by said controller.

58. The portable safe of claim 41 further comprising a clip disposed on an exterior surface of either of said back plate or said cover for removable attachment to an exterior structure, and further comprising a clip sense circuit, said clip sense circuit in communication with said controller and providing a clip sense signal to said controller communicating to the controller whether said clip has been removably attached to an exterior structure.

59. The portable safe of claim 58, wherein said non-transitory computer readable medium comprising computer-executable instructions further comprises instructions for the step of commanding said electromechanical lock into an unlocked state in the case in which an authorized personal identification code has been received by said controller and said clip sense circuit signal indicates to said controller that said clip has been removably attached to an exterior structure within a first predetermined time from reception of an authorized personal identification code by said controller.

60. The portable safe of claim 59 in which said first predetermined time is thirty seconds.

61. The portable safe of claim 60, wherein said non-transitory computer readable medium comprising computer-executable instructions further comprises instructions for the step of causing an alarm message to be transmitted through said at least one remote user data interface to a remote user in the case in which an authorized personal identification code is not received by said controller within a second predetermined time from the time said clip sense circuit signal indicates to said controller that said clip has been removed from an exterior structure.

62. The portable safe of claim 59, wherein said non-transitory computer readable medium comprising computer-executable instructions further comprises instructions for the step of commanding said electromechanical lock into a locked state when said clip sense signal indicates to said controller that said clip has been removed from an exterior structure.

63. The portable safe of claim 59, further comprising a speaker in communication with said controller, and wherein said non-transitory computer readable medium comprising computer-executable instructions further comprises instructions for the step of causing an audible alarm to be transmitted through said speaker in the case in which an authorized personal identification code is not received by said controller within a second predetermined time from the time said clip sense circuit signal indicates to said controller that said clip has been removed from an exterior structure.

64. The portable safe of claim 59, wherein said non-transitory computer readable medium comprising computer-executable instructions further comprises instructions for the step of causing said lighting element to illuminate in the case in which an authorized personal identification code is not received by said controller within a second predetermined time from the time said clip sense circuit signal indicates to said controller that said clip has been removed from an exterior structure.

65. The portable safe of claim 41, wherein said at least one remote user data interface is further defined as comprising at least one radio frequency transceiver.

66. The portable safe of claim 65, wherein said non-transitory computer readable medium comprising computer-executable instructions further comprises instructions for the step of commanding said lighting element to illuminate when said at least one radio frequency transceiver has established a communication link with a remote radio frequency transceiver.

67. The portable safe of claim 65, wherein said at least one radio frequency transceiver comprises a wireless LAN transceiver and a cellular data network transceiver.

68. The portable safe of claim 67, wherein said non-transitory computer readable medium comprising computer-executable instructions further comprises instructions for the step of selecting said wireless LAN transceiver as a primary wireless communication means for communicating with a remote user, and using said cellular data network transceiver for communication with a remote user only when said wireless LAN transceiver has not established a communication link with a remote radio frequency transceiver.

69. The portable safe of claim 41, wherein said at least one remote user data interface is further defined as comprising a wired electrical interface.

70. The portable safe of claim 69, wherein said wired electrical interface is a serial data interface.

71. The portable safe of claim 41, wherein said at least one remote user data interface is further defined as comprising an optical transceiver.

72. The portable safe of claim 41, further comprising battery charger and power conditioning circuit in communication with said controller and said battery and producing a signal containing battery charge level information; and wherein said non-transitory computer readable medium comprising computer-executable instructions further comprises instructions for the steps of receiving said signal containing battery charge level information, and causing said lighting element to periodically illuminate with a first color in the case in which said battery charge level is below a predetermined low-charge threshold.

73. The portable safe of claim 72, wherein said non-transitory computer readable medium comprising computer-executable instructions further comprises instructions for the step of causing said lighting element to illuminate with said first color in the case in which said battery charge level is below a predetermined medium-charge threshold but is not below a predetermined low-charge threshold.

74. The portable safe of claim 72, wherein said non-transitory computer readable medium comprising computer-executable instructions further comprises instructions for the step of causing said lighting element to illuminate with a second color in the case in which said battery charge level is not below a predetermined medium-charge threshold.

75. The portable safe of claim 41, further comprising:

a battery charger and power conditioning circuit in communication with said controller and said battery, said battery charger and power conditioning circuit producing a signal containing battery charge level information; and an open/close circuit producing a signal indicating whether said back plate and cover are disposed in an open position or a closed position;

wherein said non-transitory computer readable medium comprising computer-executable instructions further comprises instructions for the steps of:

receiving said signal containing battery charge level information;

receiving said open/close signal to determine whether said back plate and said cover are in a closed position or an open position;

transmitting a message to a remote user through said remote user data interface in the event said battery charge level information indicates that said battery charge is below a predetermined low-charge threshold;

waiting for a predetermined time period to receive a remote unlock command from a remote user;

commanding said electromechanical lock to an unlocked state if a remote unlock command is received from a remote user within said predetermined time period; and commanding said electromechanical lock to a locked state if no remote unlock command is received from a remote user within said predetermined time period and if the back plate and said cover are in a closed position.

* * * * *